US010096231B1

(12) United States Patent
Slavin et al.

(10) Patent No.: US 10,096,231 B1
(45) Date of Patent: Oct. 9, 2018

(54) CONTEXTUAL COMMUNICATION OF EVENTS

(71) Applicant: Alarm.com Incorporated, Tysons, VA (US)

(72) Inventors: Alison Jane Slavin, Falls Church, VA (US); Abraham Joseph Kinney, Vienna, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 15/613,430

(22) Filed: Jun. 5, 2017

Related U.S. Application Data

(63) Continuation of application No. 14/584,849, filed on Dec. 29, 2014, now Pat. No. 9,672,717.

(60) Provisional application No. 61/921,261, filed on Dec. 27, 2013.

(51) Int. Cl.
*G08B 23/00* (2006.01)
*G08B 21/18* (2006.01)
*G08B 5/36* (2006.01)

(52) U.S. Cl.
CPC ..... *G08B 21/18* (2013.01); *G08B 5/36* (2013.01)

(58) Field of Classification Search
None
See application file for complete search history.

(56) References Cited

U.S. PATENT DOCUMENTS

| | | | | |
|---|---|---|---|---|
| 9,196,148 | B1 * | 11/2015 | Hutz | G08B 21/18 |
| 2003/0234725 | A1 * | 12/2003 | Lemelson | G08B 7/066 340/521 |
| 2010/0094636 | A1 | 4/2010 | Becker | |
| 2010/0253531 | A1 | 10/2010 | Qiu | |
| 2010/0289644 | A1 | 11/2010 | Slavin | |
| 2014/0047001 | A1 | 2/2014 | Phillips | |
| 2014/0266684 | A1 | 9/2014 | Poder | |
| 2015/0077737 | A1 | 3/2015 | Belinsky | |
| 2015/0163535 | A1 * | 6/2015 | McCarthy, III | G07C 9/00571 725/49 |
| 2016/0065528 | A1 | 3/2016 | Weksler | |

* cited by examiner

*Primary Examiner* — Brian Zimmerman
*Assistant Examiner* — Kevin Lau
(74) *Attorney, Agent, or Firm* — Fish & Richardson P.C.

(57) ABSTRACT

An electronic system is described that receives data collected by a monitoring system, where the monitoring system includes a notification device that is tunable between different states that discreetly convey contextual alerts based on prior association of the states with contextual alerts. The system analyzes the monitoring system data against one or more event profiles that define events relating to the property or one or more users of the property. Based on the analysis of the monitoring system data, a particular event is identified. Information that specifies contextual alerts to be provided by the monitoring system that each correspond to an event defined by the one or more event profiles is accessed. A particular contextual alert that corresponds to the particular event is identified. The system causes output of the particular contextual alert at the notification device included in the monitoring system by changing a state of the notification device.

17 Claims, 9 Drawing Sheets

CONTEXTUAL COMMUNICATION OF EVENTS

CROSS-REFERENCE TO RELATED APPLICATIONS

This application is a continuation (and claims the benefit of priority under 35 USC 120) of U.S. application Ser. No. 14/584,849, filed Dec. 29, 2014, now allowed, which claims the benefit of U.S. Provisional Application No. 61/921,261, filed Dec. 27, 2013. Both of these prior applications are incorporated herein by reference in their entirety for all purposes.

TECHNICAL FIELD

This application relates to a notification device.

BACKGROUND

A notification device, such as a tunable light emitting diode (LED) notification device, can integrate with a monitoring system to enable the notification device to provide contextual alerts to users of a property. In some cases, the notification device can provide different contextual alerts based on the monitoring system detecting one or more different events, conditions, and/or user locations.

SUMMARY

Techniques are described for providing contextual alerts that are specific to detected events, conditions, and/or user locations.

Implementations of the described techniques may include hardware, a method or process implemented at least partially in hardware, or a computer-readable storage medium encoded with executable instructions that, when executed by a processor, perform operations.

The details of one or more implementations are set forth in the accompanying description below. Other features will be apparent from the description of the drawings.

DETAILED DESCRIPTION

Figure 1A:
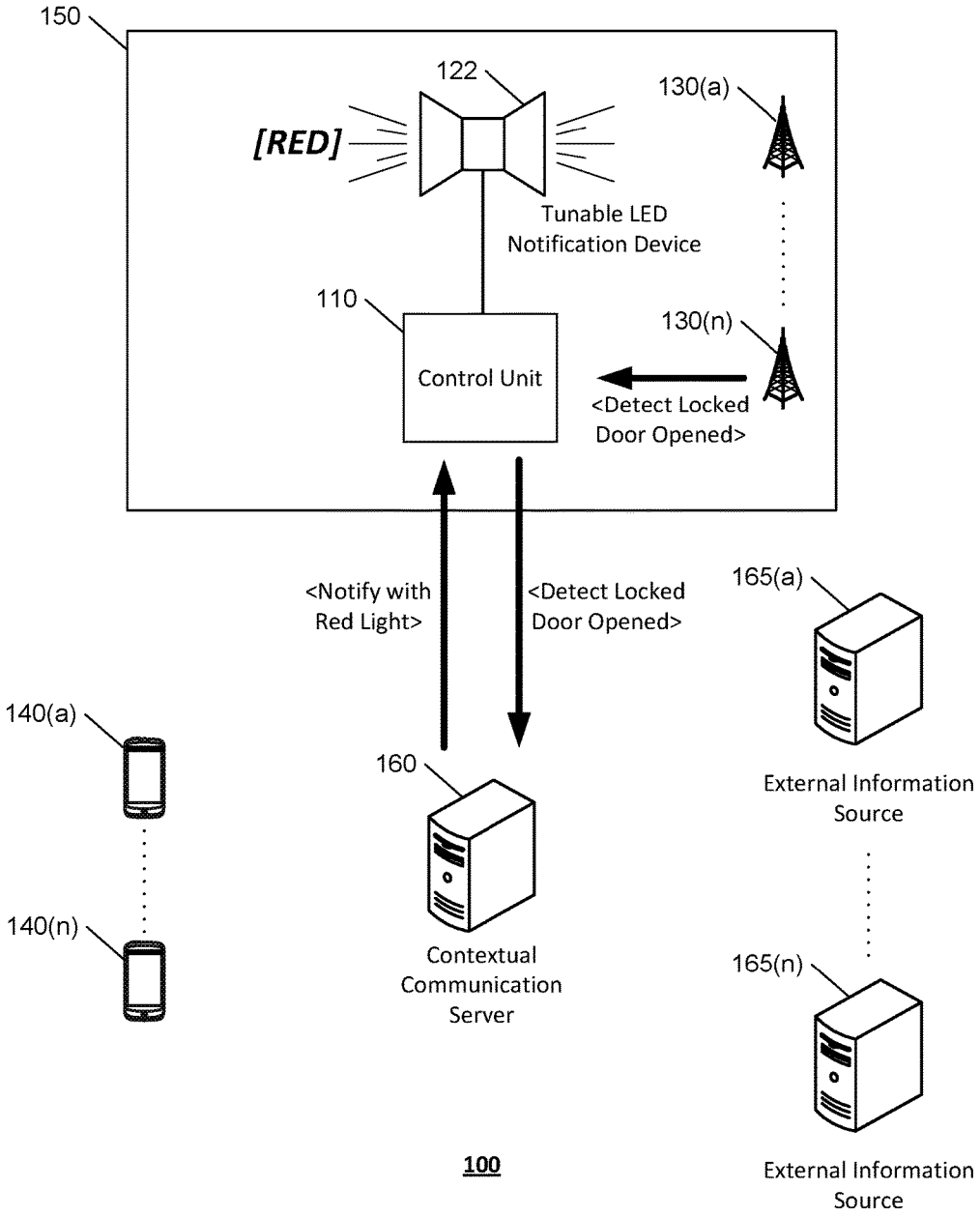
FIGS. 1A-1D illustrate an example of providing contextual alerts using a notification device and a monitoring system.

Techniques are described for providing contextual alerts that are specific to detected events. In some implementations, a monitoring system that includes a notification device, such as a tunable light emitting diode (LED) light, is able to detect triggering events relating to a home, business, vacation, or other property, or a user of a property. Triggering events can be detected by sensors associated with a monitoring system of the property, can be detected using geo-location services that are associated with the monitoring system, or can be detected based on other information received by the monitoring system. The monitoring system determines a contextual alert to provide in response to a triggering event, and controls the notification device to provide the contextual alert. By using notification devices, such as lights or devices that produce an audible or haptic alert, the monitoring system can provide discreet and efficient communication of events to users of a property. For instance, the monitoring system may discreetly and efficiently provide a notification by changing a color and/or flashing a light to signify that an event has occurred without interrupting a user with a traditional alert.

In some implementations, the monitoring system may operate a single notification device or a disaggregated notification device that provides contextual alerts throughout different regions of a property. For example, the monitoring system may operate a single tunable LED light to provide contextual alerts, or may operate a tunable LED light in each room of a home to provide contextual alerts. In some implementations, one or more notification devices associated with the monitoring system may be located at a property that is remote from the property monitored by the monitoring system. For example, a notification device at a user's office may be associated with their home monitoring system and may provide contextual alerts at the user's office based on events detected by the monitoring system at the user's home. The monitoring system can receive information associated with the property (e.g., from one or more sensors that are placed throughout the property), can receive information associated with users of the property (e.g., geographical locations of users of the property or financial data associated with users of the property), or can receive other information (e.g., data communicating weather reports, news reports, a status of appliances or other systems at the property such as a heating, ventilation, and air conditioning (HVAC) system or oven, a time and date, etc.). Based on the information, the monitoring system can detect a triggering event. The monitoring system can control the notification devices to provide a notification to the users of the property, where the notification is specific to the detected triggering event and geographically displayed to the user in their location in the home. For example, the monitoring system can receive data that indicates a house keeper has entered a home, and can cause a tunable LED light to flash amber in the basement to notify the users of the home of the activity.

FIGS. 1A-1D illustrate an example of providing contextual alerts using a notification device that is associated with a monitoring system. For example, users of a property may desire to configure a monitoring system and notification device to provide contextual alerts that are determined based on the monitoring system detecting one or more events, conditions, or user locations relative to the property.

In the example shown in FIG. 1A, a monitoring system 100 includes a notification device 122 and a control unit 110 associated with a property 150, and further includes a contextual communication server 160. The control unit 110 is in communication with one or more sensors 130(*a*)-130(*n*). The contextual communication server 160 is also capable of communicating with one or more mobile devices 140(*a*)-140(*n*) and one or more external information sources 165(*a*)-165(*n*). In some implementations, the contextual communication server 160 may be in communication with the control unit 110, the mobile devices 140(*a*)-140(*n*) and the external information sources 165(*a*)-165(*n*) over one or more networks. The control unit 110 may further be in communication with the notification device 122 and the one or more sensors 130(*a*)-130(*n*) over one or more networks. The mobile devices 140(*a*)-140(*n*) and the external information sources 165(*a*)-165(*n*) are capable of providing information to the contextual communication server 160 related to providing contextual alerts to users of the property 150. Similarly, the control unit 110 is capable of receiving information from the one or more sensors 130(*a*)-130(*n*) associated with the property 150, and of providing the sensor data to the contextual alert server 160. The contextual alert server 160 can determine a contextual alert based on the received information and can send information to the control unit 110 that causes the control unit 110 to control the notification device 122 to provide a particular contextual alert. As shown in FIGS. 1A-1D, the notification device 122 includes a tunable LED.

As shown in FIG. 1A, a sensor 130(*n*) associated with the monitoring system 100 has detected that a locked door associated with the property 150 has been opened. For example, the sensor 130(*n*) may be a sensor that is capable of determining whether a door is open, and whether the door is locked. The sensor 130(*n*) may detect the door being opened while locked, and can transmit information to the control unit 110 indicating that the locked door has been opened. The control unit 110 can transmit information to the contextual communication server 160 indicating that the locked door has been opened.

Based on receiving the information, the contextual communication server 160 can determine a contextual alert for notifying users of the property 150 that the locked door has been opened. For example, the contextual communication server 160 can access settings or other configuration information that specifies contextual alerts to provide in response to the monitoring system 100 detecting different events, conditions, or user locations, and the contextual communication server can identify a particular contextual alert to provide in response to the monitoring system 100 determining that the locked door has been opened. The contextual communication server 160 can then transmit information to the control unit 110 that enables the control unit 110 to control the notification device 122 such that the notification device 122 provides the particular contextual alert. For example, the contextual communication server 160 can determine that an appropriate contextual alert to provide in response to the locked door being opened is to cause the tunable LED included in the notification device 122 to glow red. The contextual communication server 160 can transmit information to the control unit 110 over one or more networks that indicates that the tunable LED should glow red. The control unit 110 can receiving the information, and can control the tunable LED included in the notification device 122 to display a red light.

In some instances, the contextual communication server 160 determines that a particular event, condition, or user location warrants an alert based on comparing information received from the various sensors 130(*a*)-130(*n*) or other sources, e.g., the external information sources 165(*a*)-165(*n*) or mobile devices 140(*a*)-140(*n*), to one or more conditions associated with a particular event and determining that the received information or other information satisfies the conditions of the particular event. For example, the contextual communication server 160 may determine that the locked door has been opened based on receiving information that indicates both that the particular door is currently in a locked state, and that the particular door is currently in an open state. Determining that other events have occurred may require receiving information satisfies other conditions. For example, in response to receiving data that indicates that a furnace of the property 150 is current operating, that a thermostat associated with the property is set to 70° F., and that a current temperature in the property is 60° F., the contextual communication server 160 may determine that a the furnace of the property 150 is likely malfunctioning, and may determine to present a contextual alert that corresponds to determining that the furnace of the property 150 is malfunctioning.

In some instances, the contextual communication server 160 may receiving information and may determine that two or more events have occurred. In such an example, the contextual communication server may select a particular event from among the two or more events, and may cause the notification device 122 to provide a contextual alert relevant to the particular event. Alternatively, the contextual communication server 160 may determine that the two or more events have occurred, and may control two or more different notification devices such as the notification device 122 to provide different contextual alerts associated different events included in the two or more determined events. For example, the contextual communication server may determine that a furnace of the property 150 is not functioning properly, and may also determine that a locked door at the property has been opened. In response to detecting both of these events, the contextual communication server 160 may determine to provide a contextual alert indicating that the locked door has been opened, and may control the notification device 122 to output a contextual alert corresponding to the locked door being opened.

In some implementations, the contextual communication server 160 can determine which contextual alert to provide based on information from one or more different sources. For example, the contextual communication server 160 can receive the information indicating that the sensor 130(*n*) has detected a locked door being opened, and can also receiving information from one or more other sensors 140(*a*)-140(*n*), one or more mobile devices 140(*a*)-140(*n*), and/or one or more external information sources 165(*a*)-165(*n*). Based on the received information, the contextual communication server 160 can determine a particular contextual alert to provide via the notification device 122. For example, the contextual communication server 160 can determine one or more events, conditions, or user locations based on the received information. Based on determining the one or more events, conditions, or user locations, the contextual communication server 160 can select a particular contextual alert to provide via the notification device 122. For example, the contextual communication server 160 can select a particular contextual alert that is associated with a particular one of the determined events, conditions, or user locations, e.g., an event, condition, or user location that is determined to be the most critical or most relevant in time or space.

In some instances, the contextual communication server 160 can determine which determined event, condition, or user location is the most critical based on an importance score associated with each of the particular events, where the importance score may indicate a perceived overall importance of an event or the perceived importance of the event relative to time. For example, the contextual communication server 160 may determine that an importance score for a furnace malfunctioning is higher than an importance score for a locked door being opened, and may therefore output a contextual alert relating to the furnace malfunctioning. Alternatively, the contextual communication server 160 may determine that a time-sensitive importance score associated with a locked door being opened is greater than a time-sensitive importance score associated with a furnace malfunctioning, and may therefore determine to provide a contextual alert indicating that the locked door has been opened.

In some implementations, the control unit 110 may be capable of controlling multiple notification devices, including the notification device 122. In such an implementation, the contextual communication server 160 can select two or more contextual alerts based on the received information, and can transmit information to the control unit 110 that enables the control unit 110 to control two or more notification devices to provide the selected contextual alerts. For example, the contextual communication server 160 may determine output a red light contextual alert at the notification device 122, and may determine to output a blue light contextual alert at another notification device associated with the monitoring system 100. The contextual communication server 160 can transmit information to the control unit 110 such that the control unit 110 can then control the notification device 122 and the other notification device to output their respective alerts.

Figure 1B:
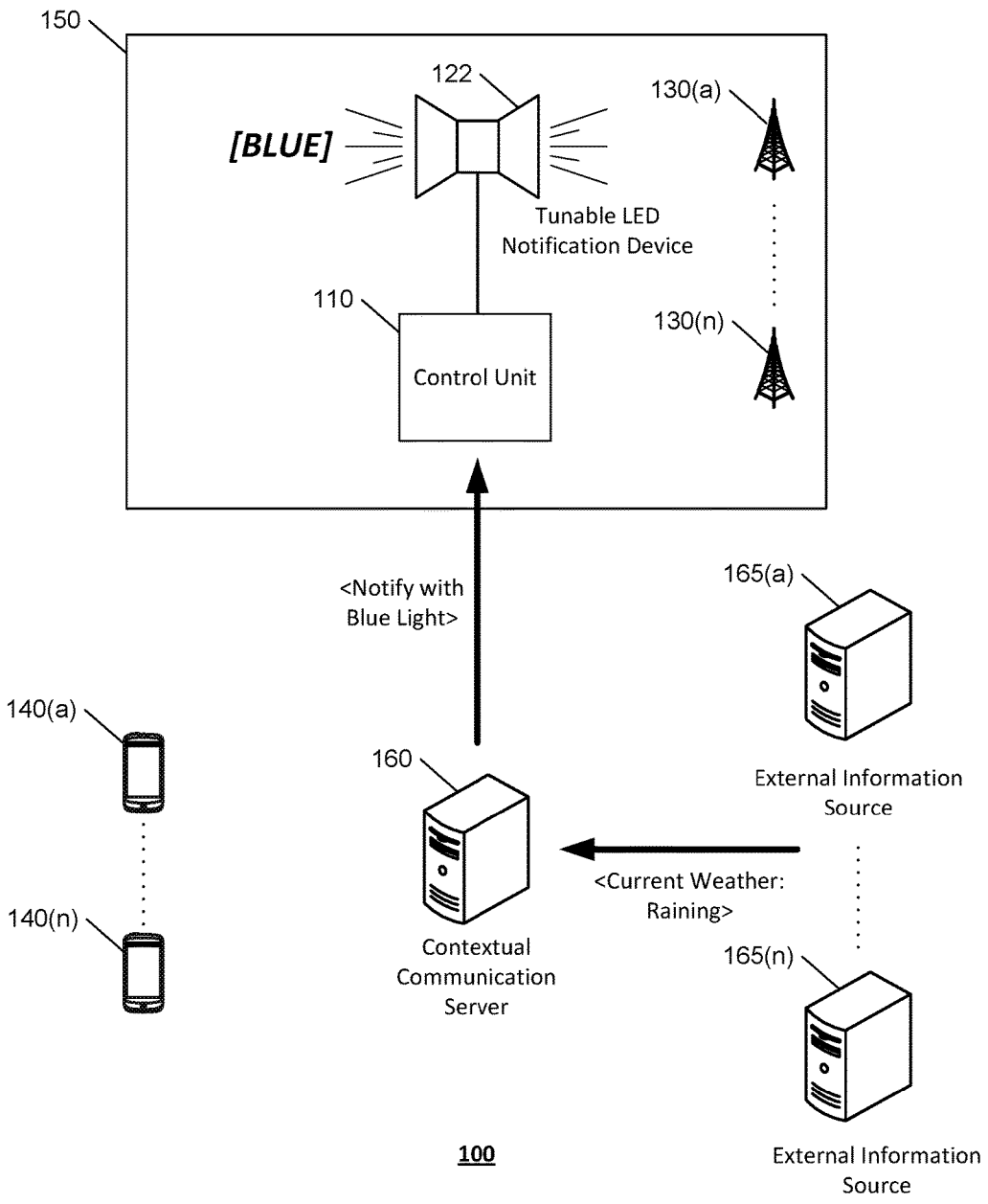

FIG. 1B depicts a second example in which the monitoring system 100 provides a different contextual alert at the notification device 122 that corresponds to a different event detected by the monitoring system 100. In the example shown in FIG. 1B, the monitoring system 100 determines an event based on information received from the external information sources 165(*a*)-165(*n*). As shown in FIG. 1B, the contextual communication server 160 receives information from one or more external information sources 165(*a*)-165(*n*). Based on the information received from the one or more external information sources 165(*a*)-165(*n*), the contextual communication server 160 determines that a particular event has occurred, that a particular condition has been satisfied, or that a particular user associated with the property 150 is in a particular location or distance relative to the property 150. The contextual communication server 160 then accesses information that indicates contextual alerts that are associated with different events. The contextual communication server 160 can select a particular contextual alert to provide in response to detecting the event, and can transmit information to the control unit 110 that specifies the particular contextual alert or that enables the control unit 110 to control the notification device 122 to produce the particular contextual alert. For example, once the contextual communication server 160 has determined the particular event, the contextual communication server 160 can select a contextual alert that causes the tunable LED included in the notification device 122 to glow blue. The contextual communication sever 160 can then transmit information to the control unit 110 that specifies that the control unit 110 should control the tunable LED in the notification device 122 to glow blue. Additionally or alternatively, the contextual communication server 160 can access data that enables the control unit 110 to control the tunable LED to glow blue, and can transmit the data to the control unit 110. The control unit 110 can then use the data to control the tunable LED included in the notification device 122 to glow blue.

In some implementations, the information received by the contextual communication server 160 from the external information sources 165(*a*)-165(*n*) may include, for example, weather data, traffic data, financial data associated with a particular user, information indicating bills, news information, emergency relevant to emergencies, or other information that can be utilized to determine that one or more events have occurred, or conditions have been met.

For example, the contextual communication server 160 may receiving information from one or more external information sources 165(*a*)-165(*n*) that indicates that it is likely to rain in the geographical area of the property 150, or the contextual communication server 160 may determine based on the received information that it is likely to rain in the geographical area of the property 150 that day. The contextual communication server 160 may access information that specifies contextual alerts to provide in response to determining various events, conditions, or user locations, and can select a particular contextual alert that is associated with determining that it is likely to rain in the geographical area of the property 150 on that day. For example, the contextual communication server 160 can select a contextual alert that causes a tunable LED associated with the monitoring system 100 to glow blue in response to determining that it is likely to rain in the geographical area of the property 150 that day. The contextual communication server 160 can then transmit information to the control unit 110, and based on the information received from the contextual communication server 160, the control unit 110 can control the tunable LED included in the notification device 122 to glow blow. In this way, for example, a user of the property 150 who is about to leave their home for the day may be provided with a subtle contextual alert in the form of a glowing blue light that indicates that it is likely to rain that day, so that the user may prepare for the rain, e.g., by wearing a jacket or bringing an umbrella with them.

Figure 1C:
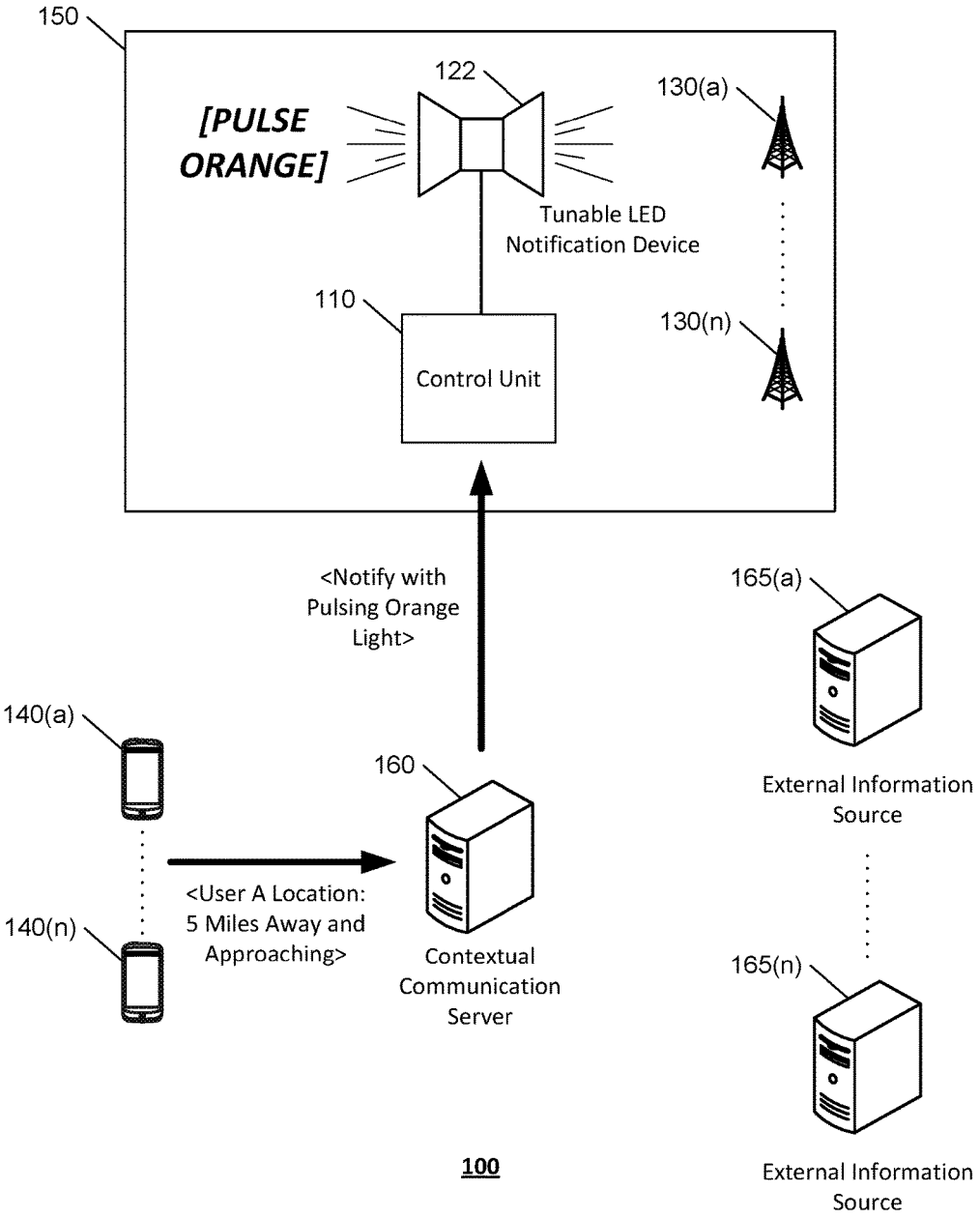

FIG. 1C illustrates a third example in which the monitoring system 100 determines that an event has occurred, that a particular condition has been met, or that a user location matches a particular geographical location or location relative to the property 150, and provides a contextual alert based on the determination. As shown in FIG. 1C, the contextual communication server 160 receives information from one or more mobile devices 140(*a*)-140(*n*). Based on the received information, the contextual communication server 160 determines that a particular event, condition, or user location satisfies conditions relevant to providing a particular contextual alert. The contextual communication server 160 provides information to the control unit 110 relevant to providing a contextual alert corresponding to the determined event, condition, or user location. The control unit 110 utilizes the information received from the contextual communication server 160 to control the notification device 122, for example, by causing the tunable LED included in the notification device 122 to pulse an orange color.

For example, the information received at the contextual communication server 160 may indicate that one of the mobile devices 140(*a*)-140(*n*) associated with a particular user is within a threshold distance of the property 150, such as within five miles of the property 150 and moving in a direction that is approaching the property 150. Based on determining that the mobile device associated with the particular user is within a threshold distance of the property 150, the contextual communication server 160 can determine a contextual alert to provide. For example, the contextual communication server 160 may determine to cause a tunable LED associated with the notification device 122 to pulse an orange color in response to determining that the mobile device associated with the particular user of the property 150 is within the threshold distance of the property 150. The contextual communication server 160 transmits information to the control unit 110 that enables the control unit 110 to control the tunable LED included in the notification device 122 to pulse an orange color. The control unit 110 utilizes the received information to control the tunable LED included in the notification device 122 to pulse an orange color. For example, the control unit 110 can transmit information to the notification device 122 that causes the tunable LED included in the notification device 122 to pulse an orange color, or may transmit information to the notification device 122 that enables the notification device 122 to control its tunable LED to pulse an orange color.

Figure 1D:
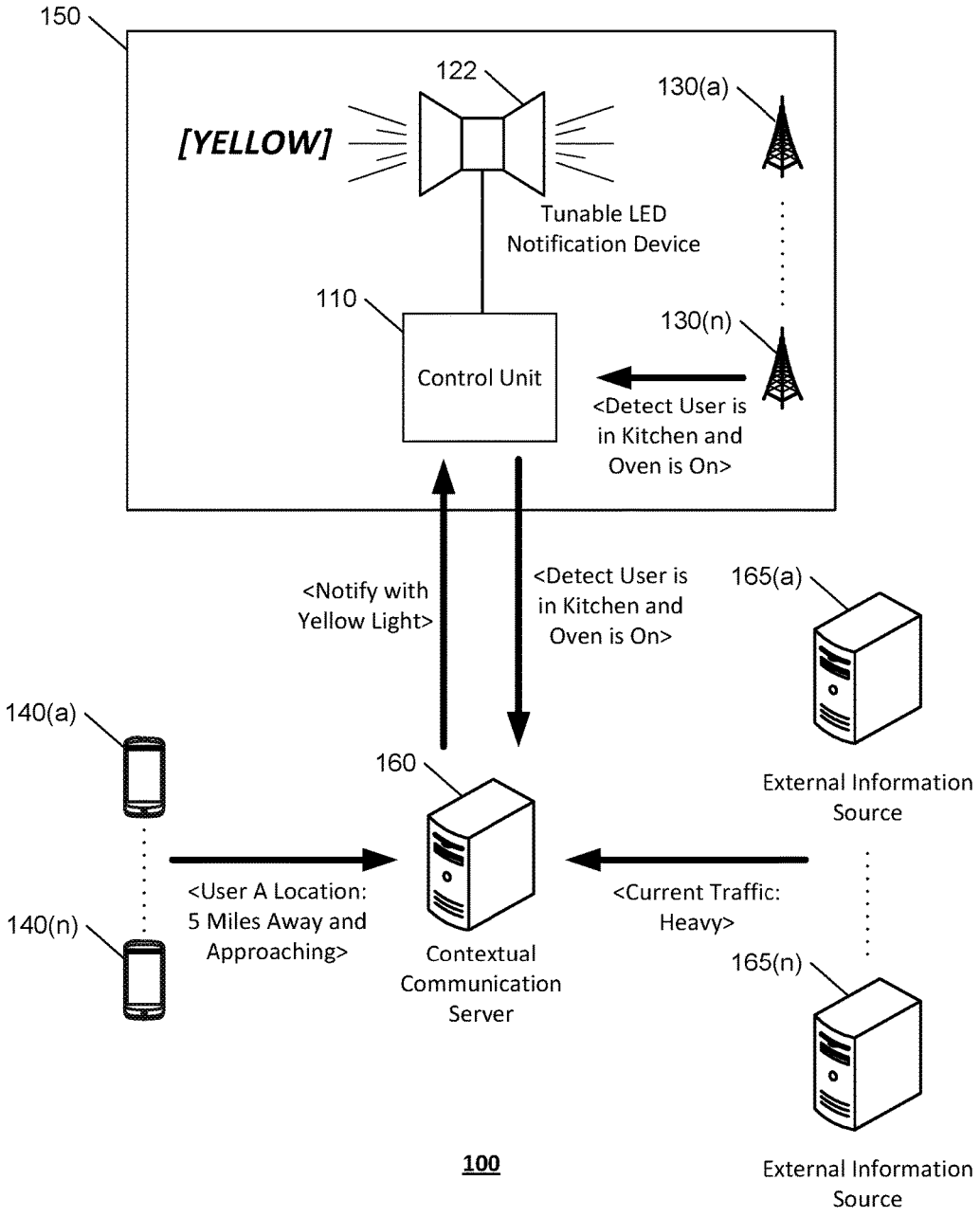

FIG. 1D depicts a fourth example in which the monitoring system 100 detects one or more events, conditions, or user locations, and determines to provide a contextual alert corresponding to one or more of the detected events, conditions, or user locations. In the example shown in FIG. 1D, the contextual communication server 160 receives information from each of one or more sensors 130(*a*)-130(*n*) associated with the property 150, from one or more mobile devices 140(*a*)-140(*n*) associated with users of the property 150, and from one or more external information sources 165(*a*)-165(*n*). Based on the received information, the contextual communication server 160 can determine a particular event or events for which to provide contextual alerts, and transmits information to the control unit 110 relevant to providing the contextual alerts. The control unit can then control the tunable LED included in the notification device 122 to provide the contextual alerts.

For example, as shown in FIG. 1D, the contextual communication server 160 receives information from the one or more sensors 130(*a*)-130(*n*) associated with the property 150 that indicates that a user of the property 150 is in the kitchen of the property and that the oven in the kitchen is turned on. The contextual communication server 160 also receives information from a mobile device associated with a particular user of the property 150 indicating that the particular user is within five miles of the property 150 and is approaching the property 150. The contextual communication server 160 also receives information from one or more of the external information sources 165(*a*)-165(*n*) indicating that there is currently heavy traffic in the area of the property 150, or along a route that one or more users of the property 150 use, e.g., a route that a particular user typically takes to work. Based on the received information, the contextual communication server determines whether an event, condition, or user location warrants a contextual alert. For example, the contextual communication server 160 may determine that the information received from the one or more sensors associated with the property 150 do not indicate that an event or condition warranting a contextual alert has occurred, e.g., that a user having the oven turned on while they are in the kitchen is not an abnormal occurrence. The contextual communication server 160 can further determine that a user of the property 150 being within 5 miles of the property 150 and approaching the property 150 may not warrant a contextual alert, may not warrant a contextual alert at that particular time, or may not be associated with an importance score indicating that the user being within five miles and approaching the property 150 is an important event. However, the contextual communication server 160 can further determine that the current traffic is a condition requiring a contextual alert. For example, the contextual communication server 160 can determine that the heavy traffic condition is associated with an importance score indicating that the traffic condition requires a contextual alert, e.g., based on the importance score satisfying a particular threshold.

Based on determining that the traffic condition necessitates a contextual alert, the contextual communication server 160 can access information that indicates a contextual alert to provide associated with the traffic condition, for example, information that indicates that a yellow light should be displayed by the notification device 122 as a contextual alert relating to the traffic condition. The contextual communication server 160 can transmit information to the control unit 110 that enables the control unit 110 to cause the tunable LED associated with the notification device 122 to glow yellow. The control unit 110 can utilize the information received from the contextual communication server 160 to control the tunable LED included in the notification device 122 and cause the tunable LED to glow yellow as a contextual alert notifying users of the property 150 of the heavy traffic condition.

In some implementations, the contextual communication server 160 can determine to display multiple contextual alerts based on the received information. For example, in FIG. 1D the contextual communication server 160 can determine to provide contextual alerts related to both the heavy traffic condition and the user of the property 150 being within five miles and approaching the property 150. Based on this determination, the contextual communication server 160 can identify contextual alerts to provide for each of these events or conditions, and can transmit information to the control unit 110 to enable both of the contextual alerts to be provided. For instance, the contextual communication server 160 can transmit information to the control unit 110 that causes the tunable LED included in the notification device 122 to glow yellow to notify users of the property 150 of the heavy traffic condition, and can also transmit information to the control unit 110 that causes the tunable LED to pulse an orange color to notify users of the property 150 that a user of the property 150 is within 5 miles and approaching. Using the received information, the control unit 110 can control the tunable LED included in the notification device 122 to glow yellow for a period of time and then pulse orange for a period of time, can control the tunable LED to alternative between glowing yellowing and pulsing orange, or can otherwise control the tunable LED to display both of the contextual alerts. In some instances, the information received from the contextual communication server 160 can specify how or in what order the different contextual alerts should be provided. The monitoring system 100 is capable of providing other combinations of contextual alerts or presentations of contextual alerts, for example, by providing contextual alerts via a haptic feedback device, a speaker, or otherwise.

Figure 2:
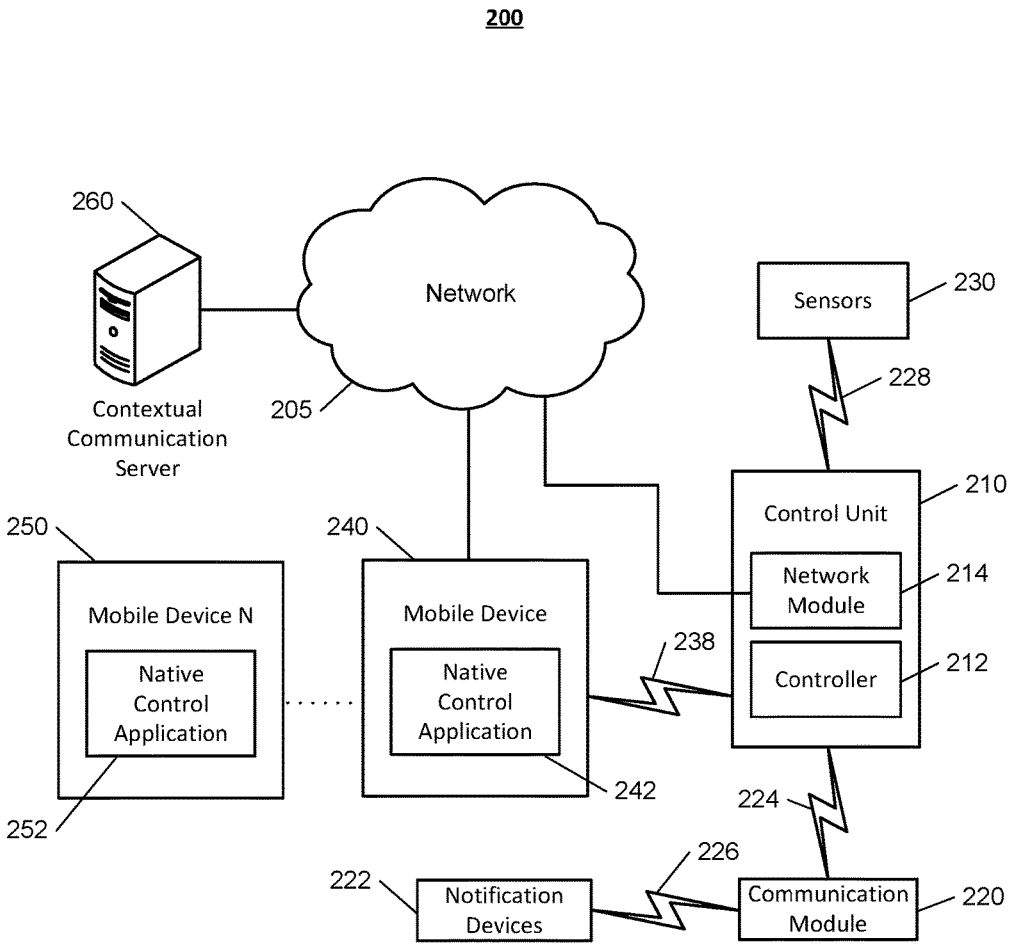
FIG. 2 illustrates an example system capable of providing contextual alerts using a notification device and a monitoring system.

FIG. 2 illustrates an example of a monitoring system 200 configured to provide contextual communication of events. The monitoring system 200 includes a network 205, a control unit 210, one or more mobile devices 240, 250, and a contextual communication server 260. The network 205 enables communications between the control unit 210, the one or more mobile devices 240, 250, and the contextual communication server 260.

The network 205 is configured to enable electronic communications between devices connected to the network 205. For example, the network 205 can be configured to enable the exchange of electronic communications between the control unit 210, the one or more mobile devices 240, 250, and the contextual communication server 260.

The network 205 can include, for example, one or more of the Internet, Wide Area Networks (WANs), Local Area Networks (LANs) (e.g., Wi-Fi), analog or digital wired and wireless telephone networks (e.g., a public switched telephone network (PSTN)), Integrated Services Digital Network (ISDN), a cellular network, and Digital Subscriber Line (DSL), Ethernet, Internet Protocol (IP) over broadband, radio, television, cable, satellite, or any other delivery or tunneling mechanism for carrying data. Network 205 can include multiple networks or subnetworks, each of which can include, for example, a wired or wireless data pathway. The network 205 can include a circuit-switched network, a packet-switched data network, or any other network able to carry electronic communications (e.g., data or voice communications). For example, the network 205 can include networks based on the Internet protocol (IP), asynchronous transfer mode (ATM), the PSTN, packet-switched networks based on IP, X.25, or Frame Relay, or other comparable technologies and can support voice using, for example, VoIP, or other comparable protocols used for voice communications. The network 205 can include one or more networks that include wireless data channels and wireless voice channels. The network 205 can be a wireless network, a broadband network, or a combination of networks including a wireless network and a broadband network.

The control unit 210 includes a controller 212 and a network module 214. The controller 212 is configured to control a device system that includes the control unit 210. For instance, the controller 212 may be configured to control one or more notification devices associated with a property. In some examples, the controller 212 can include a processor or other control circuitry configured to execute instructions of a program that controls operations of one or more sensors and one or more notification devices. In these examples, the controller 212 can be configured to receive input from one or more sensors associated with the monitoring system of the property, receive information associated with one or more users of the property, or to receive other information, and control operation of the one or more notification devices (e.g., one or more tunable LED lights, other lights, speakers, or devices that produce a haptic alert), or control operation of other devices associated with the property or the monitoring system. For example, the controller 212 can be configured to control operation of the network module 214 included in the control unit 210.

The network module 214 is a communication device configured to exchange communications over the network 205. The network module 214 can be a wireless communication module configured to exchange wireless communications over the network 205. For example, the network module 214 can be a wireless communication device configured to exchange communications over a wireless data channel. In this example, the network module 214 can transmit sensor data captured by one or more sensors of the monitoring system associated with the property, data associated with controlling one or more notification devices, data associated with users of the property, or other information over a wireless data channel. The wireless communication device can include one or more GSM modules, a radio modem, a cellular transmission module, or any type of module configured to exchange communications in one of the following formats: GSM or GPRS, CDMA, EDGE or EGPRS, EV-DO or EVDO, UMTS, or IP.

The network module 214 can also be a wired communication module configured to exchange communications over the network 205 using a wired connection. For instance, the network module 214 can be a modem, a network interface card, or another type of network interface device. The network module 214 can be an Ethernet network card configured to enable the control unit 210 to communicate over a local area network and/or the Internet. The network module 214 can also be a voiceband modem configured to enable the control unit 210 to communicate over the telephone lines of Plain Old Telephone Systems (POTS). In some implementations, the control unit 210 can be a broadband or cellular gateway where the network module 214 can enable the control unit 210 to communicate over the network 205.

The monitoring system that includes the control unit 210 communicates with the modules 220 and 230 to provide contextual alerts that are specific to detected events. The module 220 is connected to one or more notification devices 222 (e.g., LifX light bulbs from lifx.co) and is configured to control the one or more notification devices 222. The module 220 can communicate information to or from the control unit 210 and can control the one or more notification devices 222 based on commands received from the control unit 210.

In some implementations, the module 220 associated with the one or more notification devices 222 can be integrated with the notification devices 222 and/or the control unit 210. For example, the notification devices 222 can include the control unit 210 and the module 220 (e.g., as internal components of the notification devices 222). In some examples, the control unit 210 can be a gateway device that communicates with the module 220 associated with the notification devices 222.

The notification devices 222 can be configured to provide contextual alerts to detected events based on information received from the module 220. For example, the module 220 can receive information that identifies a detected event or a contextual alert to provide in response to a detected event, and the module 220 can control the notification devices 222 to emit a particular contextual alert. The notification devices 222 can include one or more lights (e.g., one or more tunable LEDs such as color changing LEDs or controllable brightness LEDs, LED light bulbs, incandescent light bulbs, fluorescent light bulbs, high intensity discharge (HID) light bulbs, liquid crystal displays (LCD), or other lights or visual notification devices), can include one or more speakers or other audible notification devices (e.g., chimes or bells), can include one or more haptic notification devices (e.g., devices that can apply a pressure, vibration, temperature, or other tactile response that is detectable by a user), or can include any other notification device (e.g., devices that provide notifications using a particular scent, taste, noise, visual cue, or other haptic response). Although illustrated as a single module 220 and a single notification device 222 module, the system 200 may include multiple modules for controlling multiple notification devices, types of notification devices, or other groups of notification devices.

The notification device 222 can be located at the property monitored by the monitoring system 200, or can be located at a different location than the property being monitored by the monitoring system 200. For example, the notification device 222 may be fixed within the property monitored by the monitoring system 200, where the fixed location of the notification device 222 may be selected such that contextual alerts provided by the notification device 222 would be readily perceived by users of the property (e.g., in a hallway, kitchen, or living room of the property). As discussed, in some instances, the monitoring system 200 can include multiple notification devices, such that there may be a notification device 222 in each of the rooms or a subset of the rooms of the property monitored by the monitoring system 200.

Additionally, the notification device 222 or a subset of multiple notification devices associated with the monitoring system 200 may be located at locations separate from the property being monitored by the monitoring system 200. For example, one or more notification devices may be located at other locations, such as an office, car, other property, etc., such that contextual alerts corresponding to events detected at the property monitored by the monitoring system 200 are provided at the notification devices that are located away from the property. For example, the notification device 222 may be located in the office of a user of the property monitored by the monitoring system 200, such that when the monitoring system 200 detects an event at the property, the monitoring system 200 controls the notification device 222 at the office to provide a contextual alert corresponding to the detected event.

The module 230 is connected to one or more sensors configured to monitor environmental conditions and/or activity at regions within the property (e.g., at various indoor locations of the property). For example, the sensors connected to the module 230 can include environmental sensors, such as temperature sensors, humidity sensors, noise sensors, light sensors, air quality sensors, smoke detectors, carbon monoxide detectors, water sensors, rain sensors, wind sensors, etc. The sensors can further include sensors for monitoring activity at the property, such as one or more motion sensors, contact sensors, etc. The module 230 connected to the one or more sensors can communicate data obtained by the sensors to the control unit 210. For example, the module 230 can transmit sensor data indicating the temperature and the motion of users in a particular room of a home to the control unit 210.

The one or more sensors also may include devices that are able to report an operational status of the devices. For instance, the one or more sensors may include electronic locks that are able to report a status of locked or unlocked. The control unit 210 may communicate (e.g., over a short-range wireless communication protocol, such as Zwave) with the electronic locks to control operation of the locks and receive events (e.g., locking or unlocking events) detected at the locks.

The modules 220 and 230 can communicate with the controller 212 over communications links 224 and 228, and the notification devices 222 can communicate with the module 220 over communication link 226. The communication links 224, 226, and 228 can be wired or wireless data pathways configured to transmit signals from the modules 220 and 230 to the control unit 210, and from the notification devices 222 to the module 220. The modules 220 and 230 can continuously transmit and receive data from the controller 212, can periodically transmit and receive data from the controller 212, or can transmit and receive data from the controller 212 in response to changes in sensed values and/or operation of the notification devices. The notification devices 222 can continuously or periodically transmit and receive information from the module 220, or can transmit and receive information from the module 220 in response to detecting a specific event (e.g., an event at the property or an error relating to one or more of the notification devices 222).

In some implementations, the notification devices 222 can communicate directly with the control unit 210. For example, the control unit 210 can communicate with the notification devices 222 to send and/or receive information related to controlling the notification devices, information identifying the status of the notification devices 222 (e.g., a current contextual alert output by the notifications devices 222 or errors relating to the notification devices 222), or other information. In some instances, the control unit 210 can communicate information directly to both the notification devices 222 and the module 220.

The contextual communication server 260 is an electronic device configured to provide contextual alert services by exchanging electronic communications with the control unit 210 and the one or more mobile devices 240, 250 over the network 205. For example, the contextual communication server 260 can be configured to monitor data obtained by the control unit 210. In this example, the contextual communication server 260 can exchange electronic communications with the network module 214 included in the control unit 210 to send and/or receive information regarding detected events (e.g., events occurring at the property, events associated with one or more users of the property, or other events). The contextual communication server 260 also can receive information relating to events from the one or more mobile devices 240, 250. For example, the contextual communication server 260 can receive information from the one or more mobile devices 240, 250 that indicates the locations of the one or more mobile devices 240, 250. The contextual communication server 260 can further receive information relating to events from one or more other sources. For example, the contextual communication server 260 can receive information over the network 205 relating to weather reports or financial information associated with users of the property.

In some implementations, the contextual communication server 260 can be connected to the Internet over the network 205 and can access information at a website or database that is accessible on the Internet. For example, users associated with a property can specify schedules or preferences relating to contextual alerts, such as by specifying the schedules or preferences at a website or application. The schedules or preferences can be accessible to the users associated with the property and the contextual communication server 260 over the network 205. Based on the accessed information, the contextual communication server 260 can communicate with the control unit 210 to control the output of contextual alerts at the property.

The contextual communication server 260 can store data (e.g., activity data associated with the property, data associated with news or weather, financial data associated with users, data associated with user schedules, or data associated with user preferences) and can perform analysis of the stored data. Based on the analysis, the contextual communication server 260 can communicate with and control aspects of the control unit 210.

The one or more mobile devices 240, 250 are devices that host one or more native applications (e.g., the native control applications 242, 252). The one or more mobile devices 240, 250 can be cellular phones or non-cellular locally networked devices. The one or more mobile devices 240, 250 can include a cell phone, a smart phone, a tablet PC, a personal digital assistant ("PDA"), a wearable computing device, or any other stationary or portable device configured to communicate over a network. For example, implementations can also include Blackberry-type devices (e.g., as provided by Research in Motion), electronic organizers, iPhone-type devices (e.g., as provided by Apple), iPod devices (e.g., as provided by Apple), or other portable music players, other communication devices, and handheld, wearable, or portable electronic devices for gaming, communications, and/or data organization. The one or more mobile devices 240, 250 can be the same or can include mobile devices of different types. The one or more mobile devices 240, 250 can perform functions unrelated to the monitoring system, such as placing personal telephone calls, playing music, playing video, displaying pictures, browsing the Internet, maintaining an electronic calendar, etc.

In some implementations, the one or more mobile devices 240, 250 communicate with and receive control system data from the control unit 210 using the communication link 238. For instance, the one or more mobile devices 240, 250 can communicate with the control unit 210 using various local wireless protocols, such as Wi-Fi, Bluetooth, Z-Wave, ZigBee, HomePlug (Ethernet over powerline), or wired protocols such as Ethernet, USB, and other wired protocols based on the RS232, RS485, and/or RS422 standards. The one or more mobile devices 240, 250 can connect locally to the control system and its sensors and other devices. The local connection can improve the speed of communications because communicating through the network 205 with a remote server (e.g., the contextual communication server 260), can be slower.

Although the one or more mobile devices 240, 250 are shown communicating with the control unit 210, the one or more mobile devices 240, 250 can communicate directly with the notification devices 222, sensors 230, and/or other devices controlled by the control unit 210. In some implementations, the one or more mobile devices 240, 250 replace the control unit 210 and perform the functions of the control unit 210 for local control and long range or offsite communication and/or control.

In other implementations, the one or more mobile devices 240, 250 receive control system data captured by the control unit 210 through the network 205. The one or more mobile devices 240, 250 can receive the data from the control unit 210 through the network 205 or from the contextual communication server 260 and can transmit or relay data to the control unit 210 or the contextual communication server 260 through the network 205. In this regard, the contextual communication server 260 can facilitate communications between the one or more mobile devices 240, 250 and the control unit 210.

Although the one or more mobile devices 240, 250 are shown in FIG. 2 as being connected to the network 205, in some implementations, the one or more mobile devices 240, 250 are not connected to the network 205. In these implementations, the one or more mobile devices 240, 250 communicate directly with one or more of the monitoring system components and no network connection (e.g., connection to the Internet), or reliance on remote servers is needed.

In some implementations, the one or more mobile devices 240, 250 are used in conjunction with only local sensors and/or local devices at a property. In these implementations, the monitoring system 200 only includes the one or more mobile devices 240, 250 and the modules 220, 222, and 230. The one or more mobile devices 240, 250 can receive data directly from the modules 220, 222, and/or 230 and send data directly to the modules 220, 222, and/or 230. The one or more mobile devices 240, 250 provide the appropriate interfaces and/or processing to provide for control of the monitoring system, including modifying monitoring system settings and/or preferences, controlling the notification devices 222, controlling the sensors 230, etc. In some implementations, the one or more mobile devices 240, 250 communicate directly with only the notification devices 222, the module 220, and the module 230 associated with the environmental and/or activity sensors to control operation of the notification devices 222 associated with the property.

The one or more mobile devices 240, 250 can each include a native control application 242, 252, respectively. The native control application 242, 252 refers to a software/firmware program running on the corresponding mobile devices that enables the described features. The one or more mobile devices 240, 250 can load or install the native control application 242, 252 based on data received over a network or data received from local media. The native monitoring application 242, 252 can run on mobile devices' platforms, such as Apple iOS, iPhone, iPod touch, Blackberry, Google Android, Windows Mobile, Mobile Linux, Firefox OS, etc.

The described monitoring system enables events to be detected and contextual alerts relating to those events to be provided to users of a property. Contextual alerts can be provided in a non-intrusive manner, such as by providing the alerts using a tunable LED light or an overhead lighting system, to enable users of the property to ascertain relevant information without being exposed to other forms of alerts that may become an annoyance or inconvenience.

Contextual alerts can be provided to users of a property based on the monitoring system identifying events based on data received from one or more sensors of a property. For example, the property associated with the monitoring system 200 can feature one or more sensors 230, such as a sensor that can detect when a front door of the property has been opened. Based on data being received from the front door sensor, for example, at the control unit 210, then monitoring system 200 can process the data received from the sensor and can cause a contextual alert to be provided that indicates that the front door has been opened. For instance, the control unit 210 may transmit the data received from the front door sensor to the contextual communication server 260, and the contextual communication server 260 can determine that the data received from the door sensor corresponds to a door opening event. The contextual communication server 260 can determine a contextual alert to provide in response to the door opening event, such as by tuning a tunable LED light at the property to shine blue, and can transmit information that causes the contextual alert to be provided. For example, the contextual communication server 260 can transmit information to the control unit 210 indicating that the tunable LED light should be tuned to shine blue, and the control unit 210 can communicate the information to the module 220, where the module 220 can then control the tunable LED light to shine blue.

Contextual alerts may also be provided to users of a property based on the monitoring system identifying events that are associated with a detected geographical location of one or more users of the property. For example, one or more users of a property may be associated with mobile devices 240, 250, where the mobile devices 240, 250 may be capable of detecting a geographical location of the mobile devices 240, 250 (e.g., using global positioning system (GPS) capabilities, Wi-Fi access point triangulation data, cellular network triangulation data, IP address information, or other geo-location services or capabilities). The monitoring system can receive data identifying a geographical location of a particular mobile device, for example, by receiving information identifying the geographical location of the mobile device at the contextual communication engine 260. The contextual communication engine 260 can detect a triggering event associated with the geographical location of the mobile device, and can transmit information associated with providing a contextual alert to report the event to the users of the property. For example, the contextual communication engine 260 can detect a triggering event based on a geographical location of a mobile device moving to within one mile of the property, indicating that the user of the property associated with the mobile device is returning home, and the contextual communication engine 260 can transmit information to cause a notification device 222 to provide a contextual alert indicating that the user of the property is returning home.

Contextual alerts may also be provided to users of a property based on the monitoring system identifying events that are detected based on other data that is received by the monitoring system. For example, the contextual communication server 260 can receive information over the network 205, where the received information can include weather forecast data for the geographical region of the property as well as local news reports for the geographical region of the property. The contextual communication server 260 can analyze the received information and can detect one or more triggering events based on the received information. For example, the contextual communication server 260 can determine that the weather forecast indicates that it is likely to rain during the day, and determine a contextual alert to provide in response to determining that it is likely to rain. The contextual communication server 260 can transmit information that causes the contextual alert to be provided to users of the property. For example, the contextual communication server 260 can transmit information to cause a tunable LED light at the property to shine blue, where the tunable LED light shining blue is a contextual alert indicating that it is likely to rain.

Contextual alerts may be provided based on events that are detected in response to a combination of data received from one or more sensors of a property and a detected geographical location of one or more users of the property. For example, data may be received at the contextual communication server 260 from one or more sensors 230 featured at the property, and the contextual communication server 260 may further receive geographical location data that identifies the geographical locations of one or more mobile devices 240, 250 associated with users of the property. The contextual communication server 260 can determine that a triggering event has occurred based on a combination of the sensor data and the geographical location data, and can control the monitoring system to provide a contextual alert associated with the event. As an example, the contextual communication server 260 can receive information that indicates that a door sensor associated with a front door of the property has detected that door being opened, and can receive geographical location data indicating that none of the users of the property are currently located at the property. Based on the received information, the contextual communication server 260 can determine that there may be an intruder within the property, and can control the monitoring system to provide a contextual alert at the property, such as by causing a tunable LED light at the property to flash red or causing exterior lights at the property to flash. The contextual communication server 260 may determine to provide that particular contextual alert with the purpose of deterring any intruders within the property and to notify any users who may be at the property of the possible intruder.

Contextual alerts may also be provided based on events that are detected in response to a combination of data received from one or more sensors of a property and other data that is received by the monitoring system of the property. For example, data may be received at the contextual communication server 260 that includes data obtained by one or more sensors 230 featured at the property, and the contextual communication server 260 may further receive information that includes weather forecast data for the geographical region of the property. The contextual communication server 260 can determine that a triggering event has occurred based on a combination of the sensor data and the weather forecast data, and can control the monitoring system to provide a contextual alert associated with the event. As an example, the contextual communication server 260 can receive information that indicates that it is likely to rain within the geographical region of the property, and can further receive information that indicates that a door sensor associated with a front door of the property has detected the door being opened. Based on the received information, the contextual communication server 260 may determine that a user of the property is likely about to leave the property, and can control the monitoring system to provide a contextual alert at the property that can indicate to the user that is about to leave the property that it is likely to rain and that they should therefore bring an umbrella. The contextual communication server 260 may determine to provide a particular contextual alert to the users of the property, such as by causing a tunable LED light at the property to flash blue, to notify the user that it is likely to rain within the geographical region of the property and that they should therefore bring an umbrella.

Contextual alerts may also be provided based on events that are detected in response to a combination of detected geographical locations of one or more users of a property and other data that is received by the monitoring system of the property. For example, data may be received at the contextual communication server 260 that includes geographical location data that identifies the geographical locations of one or more mobile devices 240, 250 associated with users of the property, and the contextual communication server 260 may further receive information that includes traffic data for the geographical region of the property. The contextual communication server 260 can determine that a triggering event has occurred based on a combination of the geographical location data and the traffic data, and can control the monitoring system to provide a contextual alert associated with the event. As an example, the contextual communication server 260 can receive information that indicates that a user of the property is approaching the property, for example, that the user is driving home from work, and can further receive information that indicates that there is heavy traffic along the route that the user is driving to return home. Based on the received information, the contextual communication server 260 can determine that the user of the property is likely to take longer than usual to return home from work, and can control the monitoring system to provide a contextual alert at the property that indicates that the user is likely to be later than usual in returning home from work. The contextual communication server 260 may determine to provide a particular contextual alert to the users of the property, such as by causing a tunable LED light at the property to shine yellow, to notify users of the property that are located at the property that the user returning home is likely to arrive later than usual.

Contextual alerts may also be provided based on events that are detected in response to a combination of data received from one or more sensors of a property, data identifying detected geographical locations of one or more users of the property, and other data that is received by the monitoring system of the property. For example, the contextual communication server 260 can receive information that includes data obtained by one or more sensors 230 featured at the property, data identifying geographical locations of one or more mobile devices 240, 250 associated with users of the property, and data that includes weather forecast data for the geographical region of the property. The contextual communication server 260 can determine that a triggering event has occurred based on a combination of the sensor data, the geographical location data, and the weather forecast data, and can control the monitoring system to provide a contextual alert associated with the event. As an example, the contextual communication server 260 can receive geographical location data that indicates that all of the users of the property have left the property aside from a single user. In additional, the contextual communication server 260 can receive data from a window sensor featured at the property that indicates that a window of the property is open, and that a front door of the property has been opened, indicating that the remaining user at the property may leave the property. The contextual communication server 260 can further receive weather forecast data that indicates a predicted high temperature of the day (e.g., that the high temperature for the day will be 200° F.). Based on the received information, the contextual communication server 260 can determine that the remaining user at the property may want to close the windows of the property and turn on an air conditioner of the property prior to leaving, to avoid the property being overly warm when the other users return. The contextual communication server 260 may determine to provide a particular contextual alert to the remaining user of the property, such as by causing a tunable LED light at the property to flash yellow, to notify the remaining user that they may want to close the windows of the property and turn on the air conditioner prior to leaving the property.

In some implementations, the monitoring system can utilize received data to determine a state of a property, and can provide contextual alerts to users of the property based on the state of the property. For example, the contextual communication server 260 can receive information that can be used to determine a state of the property. Based on the state of the property, the contextual communication server 260 can determine that a triggering event has occurred, and can control the monitoring system to provide a contextual alert associated with the event. As an example, the contextual communication server 260 can receive information that indicates that an oven in the kitchen of the property is turned on. Based on the received information, the contextual communication server 260 can control the monitoring system to provide a contextual alert at the property that indicates that the oven is still on and that the user should turn the oven off. In another example, the contextual communication server 260 can determine that a filter associated with an HVAC system of the property should be replaced, or that the energy usage or water usage at a property exceeds a predetermined budget or usage limit. Based on the determinations, the contextual communication server 260 can control the monitoring system to provide contextual alerts at the property indicating that the HVAC system filter should be replaced, or that the use of electricity or water exceeds a budget or usage limit. These alerts may be provided through a light that serves as a home status alert. For instance, the contextual communication server 260 may change the color of the light to indicate different status alerts at the property, such as changing the light to green to indicate an HVAC filter change is needed, changing the light to red to indicate gas on a range is left on, and changing the light to yellow to indicate energy usage is up.

In some implementations, the monitoring system can utilize received data to determine a state of a property, and can provide contextual alerts to users of the property based on the state of the property and data received from one or more sensors associated with the property. For example, the contextual communication server 260 can receive information that can be used to determine a state of the property, and the contextual communication server 260 may further receive data that includes data obtained by one or more sensors 230 of the property. Based on the state of the property and the received sensor data, the contextual communication server 260 can determine that a triggering event has occurred, and can control the monitoring system to provide a contextual alert associated with the event. As an example, the contextual communication server 260 can receive information that indicates that an oven in the kitchen of the property is turned on, and can further receive information from a motion sensor located in a bedroom of the property that indicates that a user of the property may be preparing to go to sleep. Based on the received information, the contextual communication server 260 can determine that the user is about to go to sleep while the oven is still turned on, and can control the monitoring system to provide a contextual alert at the property that indicates that the oven is still on and that the user should turn off the oven before going to sleep. The contextual communication server 260 may determine to provide a particular contextual alert to the user of the property who is about to go to sleep, such as by causing a tunable LED light at the property to shine orange, to notify the user that the oven is still turned on and that the user should turn off the oven before going to sleep.

The monitoring system can also utilize received data to determine a state of the property, and can provide contextual alerts to users of the property based on the state of the property and data that identifies the geographical locations of one or more users of the property. For example, the contextual communication server 260 can receive information that can be used to determine a state of the property, and the contextual communication server 260 may further receive data that identifies geographical locations of one or more mobile devices 240, 250 that are associated with users of the property. Based on the state of the property and the received geographical location data, the contextual communication server 260 can determine that a triggering event has occurred, and can control the monitoring system to provide a contextual alert associated with the event. As an example, the contextual communication server 260 can receive information that is used to determine that a lawn irrigation system associated with the property is active, and can further receive geographical location information that indicates that a user of the property is returning to the property and is nearby (e.g., that the user is almost home from work). Based on the received information, the contextual communication server 260 can control the monitoring system to provide a contextual alert at the property that indicates that the lawn irrigation system is active and that the user of the property is approaching the property, so that another user who is already located at the property can turn off the lawn irrigation system until the user returns home, in order to avoid spraying them with sprinklers of the lawn irrigation system. The contextual communication server 260 can determine to provide a particular contextual alert to the user of the property who is already located at the property, such as by causing a tunable LED light at the property to shine green, to notify the user located at the property that they should turn off the lawn irrigation system until the other user returns home.

The monitoring system can also utilize received data to determine a state of the property, and can provide contextual alerts to users of the property based on the state of the property and other data that is received by the monitoring system of the property. For example, the contextual communication server 260 can receive information that can be used to determine a state of the property, and the contextual communication server 260 may further receive information that includes weather forecast data for the geographical region of the property. Based on the state of the property and the received sensor data, the contextual communication server 260 can determine that a triggering event has occurred, and can control the monitoring system to provide a contextual alert associated with the event. As an example, the contextual communication server 260 can receive information that indicates that a lawn irrigation system associated with the property is active, and can further receive weather forecast data that indicates that it is likely to rain during the day. Based on the received information, the contextual communication server 260 can control the monitoring system to provide a contextual alert at the property that indicates that the lawn irrigation system is active and that it is likely to rain during the day, so that a user of the property might turn off the lawn irrigation system in order to restrict their water usage. The contextual communication server 260 can determine to provide a particular contextual alert to the users of the property, such as by causing a tunable LED light at the property to flash green, to notify the users of the property that they should turn off the lawn irrigation system in order to conserve water in light of the weather forecast.

In some implementations, the monitoring system can utilize received data to determine a state of a property, and can provide contextual alerts to users of the property based on the state of the property and based on a combination of two or more of data received from one or more sensors associated with the property, data identifying detected geographical locations of one or more users of the property, and/or other data that is received by the monitoring system of the property. For example, the contextual communication server 260 can receive information that can be used to determine a state of the property. The contextual communication server 260 may also receive information associated with data obtained by one or more sensors featured at the property as well as data that identifies geographical locations of one or more mobile devices 240, 250 that are associated with users of the property. Based on the received information, the contextual communication server 260 can determine that a triggering event has occurred, and can control the monitoring system to provide a contextual alert associated with the event. As an example, the contextual communication server 260 can receive information that is used to determine that the property is currently in a locked state (e.g., that all of the external doors of the house are locked). The contextual communication server 260 can further receive information that indicates that all of the users of the property are located at the property (e.g., such that all of the users of the property could be asleep), and can further receive information indicating that an external door of the property has been opened (e.g., from a door sensor associated with a front door of the property). Based on the received information, the contextual communication server 260 can determine that an intruder may have entered the property, and can determine to control the monitoring system to provide a contextual alert at the property that indicates that there may be an intruder within the property. The contextual communication server 260 can determine to provide a particular contextual alert to the users of the property to indicate that there may be an intruder within the property, such as by controlling a tunable LED light to flash red.

Using received data to determine a state of a property can further enable the monitoring system to determine that the property is in an abnormal state, and the monitoring system can provide contextual alerts to users of the property based on determining that the property is in an abnormal state. For example, the contextual communication server 260 may receive information that indicates that an air conditioner associated with the property is turned on and that a current temperature within the property is 85° F. Based on determining that a the current state of the property is abnormal, for example, based on information accessible to the contextual communication server 260 that indicates that the temperature within the property is typically 70° F. when the air conditioner is turned on, the contextual communication server 260 can determine that a triggering event has occurred and can control the monitoring system to provide a contextual alert associated with the event (e.g., a contextual alert that indicates that the air conditioner may be malfunctioning).

In some instances, providing a contextual alert in response to determining an abnormal state of a property may depend on other information received at the contextual communication engine 260, such as data received from one or more sensors of the property, data identifying detected geographical locations of one or more users of the property, and/or other data that is received by the monitoring system of the property. For example, the contextual communication server 260 may determine that the current state of the property is abnormal based on an air conditioner associated with the property being active and a temperature within the property being 85° F. The contextual communication server 260 may receive information obtained by a sensor associated with a window of the property, and based on the information received from the window sensor indicating that the window of the property is open, the contextual communication server 260 may provide a different contextual alert than if the window was not open. For instance, the monitoring system may provide a particular contextual alert indicating that the air conditioner is likely malfunctioning if the window is closed (e.g., by tuning a tunable LED light to flash orange), and can provide a different contextual alert if the window is detected as being open (e.g., by tuning a tunable LED light to flash yellow).

In some implementations, data received and used to determine a state of a property can further enable the monitoring system to determine that one or more components of the monitoring system are malfunctioning, and the monitoring system can provide contextual alerts to users of the property based on determining that one or more components of the monitoring system are malfunctioning. For example, the contextual communication server 260 can receive information that indicates that one or more notification devices 222 are malfunctioning, for example, that one or more tunable LED lights are no longer functional, or that the contextual communication server 260 and/or control unit 210 has lost communication with one or more sensors 230 associated with the monitoring system. Based on determining that one or more components of the monitoring system are malfunctioning, the contextual communication server 260 can determine that a triggering event has occurred and can control the monitoring system to provide a contextual alert associated with the event. For example, the contextual communication server 260 can determine to provide a contextual alert that indicates that a specific notification device or sensor is malfunctioning, or can provide a contextual alert that indicates generally that the monitoring system is malfunctioning.

According to some implementations, one or more properties may be associated with one another, and the monitoring system can compare the state of a particular property to the states of one or more associated properties. Based on the comparison, the monitoring system can determine whether a triggering event has occurred, and can provide a contextual alert to users of the particular property if such a triggering event has taken place. In some instances, the monitoring system of the particular property may only determine the state of one or more associated properties based on determining that the state of the particular property is abnormal.

For example, the contextual communication server 260 may receive data obtained by a water quality sensor associated with the particular property, and may determine that the water quality is abnormally poor. Based on the determination, the contextual communication server 260 may obtain water quality data from one or more properties that are associated with the particular property (e.g., properties in the same neighborhood as the particular property, properties that utilize a monitoring service similar to that provided by the monitoring system of the particular property, etc.). The contextual communication server 260 can compare the water quality data from the particular property and the one or more other properties, and can provide a contextual alert based on the comparison. For instance, if all of the properties display abnormally poor water quality, the contextual communication server 260 may determine that there is likely a water main break or other problem associated with the water system in the region of the particular property, and may provide a particular contextual alert to notify users of the particular property of the potential water main break or problem. If the one or more other properties display normal water quality, however, the monitoring system may determine that the water quality problem is specific to the particular property, and may provide a different contextual alert to signify this condition. In some instances, the contextual communication server 260 can receive the data from the one or more associated properties over the network 205, the monitoring systems associated with the particular property and the one or more other properties may share use of the contextual communication server 260, or the contextual communication server 260 may obtain the data in another way (e.g., indirectly using one or more of the mobile devices 240, 250).

The monitoring system can utilize information received from one or more sensors of a property, data identifying detected geographical locations of one or more users of the property, and/or other data that is received by the monitoring system of the property to determine profiles of one or more users of the property and/or a profile associated with the property. The profiles corresponding to the one or more users and/or the property can be used, in some instances, to detect triggering events and to provide contextual alerts reporting the detected triggering events.

For example, the contextual communication server 260 can receive data obtained by one or more sensors of a property, and the contextual communication server 260 can develop one or more activity profiles for users of the property and/or for the property based on the sensor data. As an example, the contextual communication server 260 can determine that a door sensor associated with the property reports that the front door of the property is opened every evening around 10:00 PM, for example, so that a user of the property can take their dog for a walk. The contextual communication server 260 can include the front door opening at 10:00 PM as a typical event in a profile associated with the property, such that the monitoring system will not interpret the front door opening at that time as a triggering event associated with a potential intruder, regardless of whether the doors of the property are locked when the front door is opened.

In other examples, the contextual communication server 260 can receive data that identifies geographical locations of one or more mobile devices 240, 250 that are associated with users of the property, and the contextual communication server 260 can develop one or more activity profiles for users that are associated with the mobile devices 240, 250 and/or can develop a profile associated with the property. As an example, based on geographical location data indicating that a user typically travels from the property to a place of employment every Monday through Friday at 8:00 AM and returns home from the place of employment every Monday through Friday at 5:00 PM, the contextual communication server 260 may develop an activity profile for the user that identifies the times when the user is typically travelling to and from the property, as well as times when they typically arrive home. The activity profile can be used to provide contextual alerts to the particular user or to other users of the property. For example, the monitoring system may determine that a current time is past a time that the particular user typically returns home from work, and the monitoring system can provide a contextual alert to other users of the property indicating that the particular user is late returning home, thereby indicating that the other users may want to call the particular user to see if they are staying late at work, are stuck in traffic, have been involved in an emergency, etc.

In still other examples, the contextual communication server 260 can receive other data, such as weather data, traffic data, or financial data associated with one or more users of the property, and can develop one or more activity profiles for users of the property and/or the property based on the received data. As an example, the contextual communication server 260 can receive data that indicates that a user of the property must pay a utility bill on the first day of every month and must also pay a credit card bill on the fifteenth day of every month. The contextual communication server 260 can include these events as triggering events in a profile associated with the user of the property, and the monitoring system can provide contextual alerts based on the property of the user. For example, the monitoring system can control one or more notification devices 222 to provide a contextual alert on the first of the month pertaining to the utility bill that the user must pay, and can provide a different contextual alert on the fifteenth of the month pertaining to the credit card bill that the user must pay.

In some implementations, users of a property may be able to respond to a contextual alert provided by the monitoring system, and the monitoring system may receive information indicating the users' response to the contextual alert. In some instances, users may provide responses to contextual alerts provided by the monitoring system to acknowledge the contextual alerts (e.g., such that monitoring system ceases providing the contextual alert based on receiving the acknowledgement). In these instances, the monitoring system can provide an additional contextual alert signifying that the monitoring system has received the acknowledgement provided by the user, or that the monitoring system has detected an action performed by a user of the property in connection with a contextual alert that the monitoring system has provided. For example, the monitoring system can provide a contextual alert to a user indicating that the user has left an oven on in a kitchen of the property and, based on detecting that the oven has been turned off, can control a tunable LED light to briefly blink green to acknowledge that the user has turned off the oven.

Responses provided by users of a property to contextual alerts can be used to determine a profile of the users and/or the property, to determine a type of notification or notification device 222 used to provide a contextual alert to users of the property, or to otherwise train the monitoring system to provide contextual alerts to users of the property that are of the most use to the users of the property. For example, the monitoring system may determine that users of the property tend to acknowledge a contextual alert or to perform an action associated with a contextual alert more quickly if the contextual alert is provided in the form of a flashing light than if the contextual alert is provided by changing the color of a tunable LED light. Based on the determination, the monitoring system may determine to present contextual alerts using different methods, for example, the system may present contextual alerts that are deemed more critical or time-sensitive using a flashing light and may present less critical or less time-sensitive contextual alerts by changing the color of a tunable LED light. Similarly, if the monitoring system determines that users of the property do not respond to contextual alerts when the contextual alerts are provided between 8:00 AM and 6:00 PM on Mondays through Fridays (e.g., due to the users of the property being at their places of employment), the monitoring system may determine not to provide contextual alerts during those time periods, or may defer presenting a contextual alert associated with a triggering event detecting during that time period until after the time period has ended, for example, by providing a contextual alert associated with an event detected at 1:00 PM at 6:00 PM when the users of the property are more likely to be at the property.

As described, the monitoring system may provide different contextual alerts based on determining that different triggering events have occurred. For example, the contextual communication server 260 can control a tunable LED light to shine a first color based on detecting a first event (e.g., to shine blue based on determining that it is likely to rain), and to shine a second, different color based on detecting a second, different event (e.g., to shine red based on determining that a front door of the property has been opened). In some implementations, the monitoring system can control a single notification device 222 to communicate contextual alerts (e.g., a single tunable LED light), or the monitoring system may control multiple notification devices 222 to communicate contextual alerts (e.g., one or more tunable LED lights, one or more speakers, and/or one or more notification devices that produce haptic contextual alerts).

In some implementations, a notification device 222 may be a notification device that is associated with a default state, for example, a state that is maintained when the notification device 222 is not providing a contextual alert. For example, a notification device 222 may be a tunable LED light. The tunable LED light may have a default state in which the light displays a white light when it is not providing a contextual alert, such that the light may be used for normal lighting of the property when the light is not providing a contextual alert. Based on the monitoring system determining that a triggering event has occurred, the monitoring system can control the tunable LED light to provide a contextual alert associated with the detected event (e.g., by controlling the tunable LED light to shine red). Based on determining that the detected event has passed, or that a user of the property has acknowledged the contextual alert, the monitoring system can then control or allow the tunable LED light to return to its default state (e.g., by controlling the tunable LED light to return to shine white).

The monitoring system associated with a property may be capable, in some implementations, of determining an extent to which a triggering event has occurred, and providing a contextual alert associated with the detected event that indicates the extent to which the event has occurred. For example, the contextual communication server 260 can determine that a triggering event associated with a user of the property returning to the property has occurred, and can further determine a distance from the user to the property. The contextual communication server 260 may determine that the triggering event has occurred and the distance from the user to the property based on, for example, GPS data received from a mobile device associated with the user. Based on determining that the user is far away from the property, the contextual communication server 260 can control a tunable LED light to shine a faint red. As the user is detected as being closer to the property (e.g., as they are driving to the property), the contextual communication server 260 can determine that the user is closer to the property, and can control the tunable LED light to shine a brighter red.

In some implementations, a monitoring system can be associated with more than one property, and can provide a contextual alert that identifies a detected event and that identifies the particular property where the detected event occurred. For example, a monitoring system may be associated with a user's home, office, and vacation home. Based on detecting a particular event at one of the properties (e.g., that a front door has been opened at one of the properties), the monitoring system can provide a contextual alert that identifies both the event and the property where the event occurred. For example, determining that a front door has been opened at the user's home may result in the monitoring system controlling a tunable LED light at the user's home to shine red, while determining that a front door has been opened at the user's office may result in the monitoring system controlling a tunable LED light at the user's home to shine purple.

According to some implementations, a monitoring system associated with a property can determine a likely location of one or more users of the property, and may provide contextual alerts at different locations and/or using different methods, based on determining the likely location of the one or more users of the property. For example, a property may feature a set of notification devices 222, such as a tunable LED light in each room of the property. Based on detecting an event, the monitoring system may determine a likely location of one or more users of the property, and may only provide contextual alerts in locations corresponding to the likely locations of the one or more users. For instance, the monitoring system may receive weather data for the region of the property, and may determine that it is likely to rain based on the received weather data. The monitoring system can determine to provide a contextual alert to users of the property, where the contextual alert can indicate that it is likely to rain in the region of the property. The monitoring system may determine likely locations of users of the property and may cause contextual notifications to only be provided at locations corresponding to the likely locations of the users. For example, the monitoring system may determine that a user is located in a kitchen of the property (e.g., based on data received from a motion sensor in the kitchen of the property and/or based on GPS data received from a mobile device associated with the user), and the monitoring system can control the tunable LED light in the kitchen of the home to shine blue to communicate that it is likely to rain, without controlling other tunable LED lights in rooms of the property that are not occupied by users of the property. In some instances, based on determining that one or more users of the property are not located at the property, or based on determining that none of the users of the property are located at the property, the monitoring system may provide contextual alerts to one or more of the users using different mechanisms, such as by sending one or more users an email, text message, automated phone call, or other notification that identifies the detected triggering event.

In some implementations, a monitoring system associated with a property may determine a location associated with a detected triggering event, and may provide a contextual alert only at a location associated with the detected event. For example, the contextual communication server 260 can receive information and can determine that a triggering event has occurred based on the received information. The contextual communication server 260 can further determine a location associated with the detected triggering event. Based on detecting the event and determining the location associated with the event, the monitoring system can cause a contextual alert to be provided at a location corresponding to the event. For example, based on determining that a window in a particular room of a property has been opened, the monitoring system can control a tunable LED light to shine red only in the particular room where the window was opened.

In some implementations, a contextual alert can be associated with a time limit, such that an alert provided in response to detecting a triggering event can be provided to users of a property for a predetermined period of time. For example, based on determining that a user of a property has returned to the property, the monitoring system can determine to provide a contextual alert to one or more other users of the property that indicates that the user has returned home (e.g., by causing a tunable LED light at the property to flash blue). In some instances, the detected event can be associated with a time limit, such that the contextual alert is only provided for a set period of time. For instance, based on determining that the user of the property has returned home, the monitoring system can determine to provide a contextual alert for five minutes that indicates that the user has returned home, before ceasing to provide the contextual alert. In some implementations, different triggering events can be associated with different time limits, or may not be associated with a time limit. For example, a contextual alert associated with a user of the property returning home may only be provided for five minutes, while a contextual alert associated with a user leaving an oven turned on may be provided for one hour. Similarly, a contextual alert associated with determining that an intruder may be within the property may not be associated with a time limit (e.g., such that the contextual alert is output until a user of the property cancels the alert).

Contextual alerts provided at a property in response to detecting one or more trigger events may, in some instances, be associated with priority levels. For example, based on detecting two or more trigger events at approximately the same time, the monitoring system may identify the priority levels of the two or more trigger events, and can determine to output a single contextual alert to users of the property, where the contextual alert output at the property can be a contextual alert associated with the trigger event having the highest priority level. For example, a trigger event associated with a window of a property being open may be associated with a first contextual alert (e.g., causing a tunable LED light at the property to shine yellow) and assigned a low priority level, and another trigger event associated with an oven being left on may be associated with a second contextual alert (e.g., causing the tunable LED light at the property to shine orange) and assigned a medium priority level. Based on determining both that a window of the property is open and that the oven has been left on, the monitoring system may determine to provide a contextual alert associated with oven being left on while forgoing providing a contextual alert associated with the window being open. In some implementations, the monitoring system may determine that users of the property have turned off the oven in response to the contextual alert, and in response to the determination, can cause the contextual alert associated with the open window to be provided. In other implementations, the monitoring system may alternate between providing two or more contextual alerts (e.g., by alternating between causing the tunable LED light at the property to shine yellow and to shine orange) or may alternate between the two or more contextual alerts with an additional consideration of the priority level of each alert (e.g., by causing the tunable LED light to shine orange for five minutes, and then for the tunable LED light to shine yellow for one minute repeatedly until either of the contextual alerts are addressed).

In some instances, the monitoring system can determine a location associated with a detected triggering event and the locations of one or more users of a property, and can provide contextual alerts based on the location of the detected event and the location of the one or more users. For example, based on determining that a front door of the property has been opened, that one user of the property is located at the property, and that another user of the property is located far away from the property, the monitoring system may determine to only provide a contextual alert to the user that is located at the property (e.g., by causing a tunable LED light at the property to shine red), and to forgo providing the other user of the property a contextual alert relating to the detected event. In another example, based on determining that both of the users of the property are located far away from the property, the monitoring system may determine to provide contextual alerts to both of the users (e.g., by communicating the contextual alert to mobile devices 240, 250 associated with the users of the property), or to neither of the users. In some instances, determining whether to provide a contextual alert associated with an event to a user can include determining whether the distance from the user to the location of the detected event exceeds a threshold (e.g., a predetermined or a dynamic threshold), such that the monitoring system will only provide contextual alerts to the user if the user is within the threshold distance from the detected event. In practice, other methods may be used to determine whether to provide a contextual alert to a user (e.g., by determining the closest user to the detected event, by determining the user who most recently left the property, etc.).

In some examples, the monitoring system provides contextual alerts based on locations of users within the monitored property. In these examples, the monitoring system identifies which areas of the property are occupied and tailors the contextual alerts to those areas. For instance, if the monitoring system detects motion sensor events in a basement and a lack of motion sensor events in the upstairs bedrooms, the monitoring system provides the contextual alert in the basement, rather than in the upstairs bedrooms (e.g., changes the color of a light in the basement while maintaining the color of lights in the upstairs bedrooms). In this regard, the monitoring system identifies a location in the property where the contextual alert will likely be most effective and provides the contextual alert in that area.

As described previously, users of a property may be able to interact with the monitoring system to specify particular triggering events, contextual alerts, and/or modes of notification associated with detected triggering events. For example, a user may access an interface (e.g., over the network 205, at the contextual communication server 260, using a mobile device 240, 250, etc.) and may specify triggering events that the monitoring system associated with the property should detect, and may specify contextual alerts and/or modes of providing contextual alerts associated with the detected events. For instances, a user may specify that an event associated with a weather forecast predicting rain should be associated with a particular contextual alert, such as a tunable LED light shining blue, and the user may specify that an event associated with a garage door being open should be associated with a different contextual alert, such as a tunable LED light blinking yellow.

Figure 3:
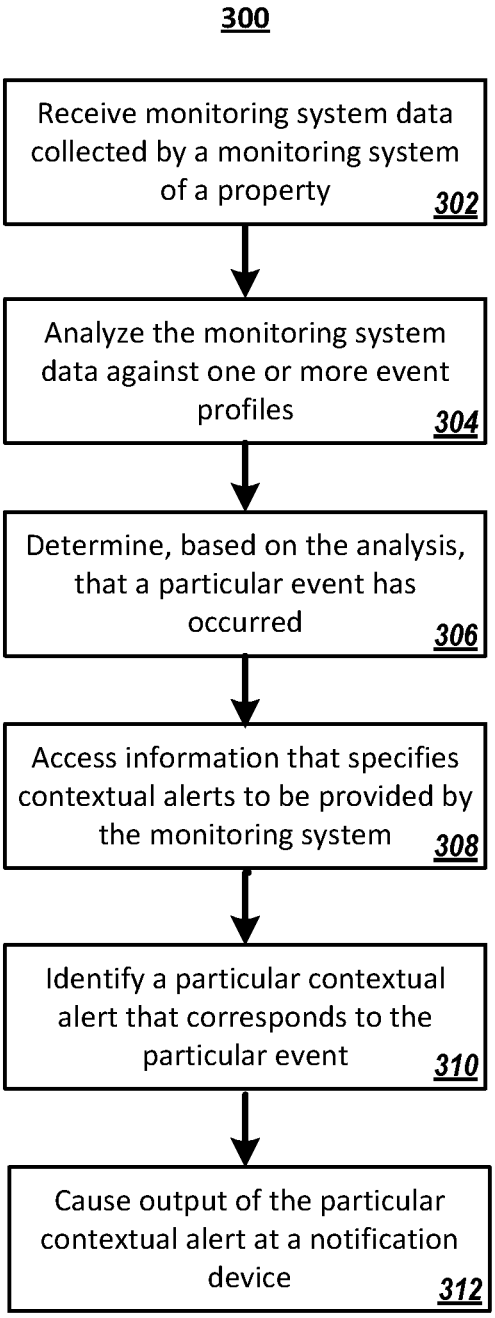
FIG. 3 depicts a flow chart of an example process.

FIG. 3 depicts a process 300 performed by a monitoring system that is associated with detecting events and providing contextual alerts based on detecting those events. As described, detecting an event may include determining that a particular event is or has taken place, that a particular condition has been met, or that a particular user of the property associated with monitoring system is at a particular geographical location or at a particular location relative to the property associated with the monitoring system. In some implementations, the process 300 may be performed by the monitoring system 200 of FIG. 2, or components of the monitoring system 200 of FIG. 2.

Monitoring system data is received that is collected by a monitoring system of a property (302). For example, one or more sensors associated with the property, external information sources, or mobile devices associated with the monitoring system may collect data indicative of events that are pertinent to the property or users of the property. As described, data collected by one or more sensors may indicate one or more of the following: a temperature, humidity, noise level, air quality, smoke amount, carbon monoxide concentration, water presence, rain presence, wind speed, wind direction, vibrations, user or object movement or presence, appliance operability or status, etc. Information received from external information sources may include weather data, traffic data, financial data, or other data relevant to the property or users of the property. Information from mobile devices associated with the property may indicate the location and/or direction of movement of users of the property.

The monitoring system data is analyzed against one or more event profiles (304). For example, after receiving the monitoring system data, the monitoring system can compare the monitoring system data against one or more event profiles that each indicate requirements necessary for a particular event to be identified as having occurred. For example, an event profile associated with a furnace of the property having malfunctioned may require that the furnace be detected as being turned on, that a difference between a current thermostat temperature setting and a current temperature within the property is not within a predetermined amount, and that the temperature in the property is not adjusting towards the temperature indicted by the thermostat. The monitoring system can analyze the received monitoring system data by comparing the received monitoring system data against the requirements specified by the event profile associated with a malfunctioning furnace event.

Based on the analysis of the monitoring system data, it is determined that a particular event has occurred (306). For example, the monitoring system can determine that a particular event has occurred based on all of the requirements indicated in the event profile associated with that particular event being met by the received monitoring system data. Returning to the example of the malfunctioning furnace, for example, the monitoring system may analyze the monitoring system data by comparing the monitoring system data against the requirements specified in the event profile associated with a furnace malfunction. Based on determining that the monitoring system data satisfies each of the requirements specified in the event profile associated with a furnace malfunctioning, the monitoring system can determine that the furnace associated with the property is malfunctioning.

Once a particular event has been determined as having occurred, the monitoring system can access information that specifies contextual alerts that can be provided by the monitoring system for each detectable event (308). For example, the monitoring system can access information that indicates contextual alerts for each of different events that the monitoring system is capable of detecting. The information can indicate, for example, a particular tunable LED output color or output pattern that corresponds to each of the detectable events. In some implementations, the detectable events include events that the monitoring system is capable of detecting and that a user of the property has indicated they would like to be notified of. For example, the user may indicate, using a preferences menu or other interface, the events for which they are interested in receiving contextual alerts. Additionally or alternatively, the user may be able to specify preferences relating to the contextual alert that is provided for a particular event. For example, the user may indicate that detection of a particular event should result in a notification device that includes a tunable LED showing a blue light.

A particular contextual alert that corresponds to the particular, detected event is identified (310). For example, based on determining that a particular event has occurred, the monitoring system can access data that specifies the contextual alerts associated with various events, and can identify a contextual alert to provide in response to the detected event. For example, based on determining that a furnace of the property is malfunctioning, and accessing the information that specifies which contextual alerts are provided in response to a specific events, the monitoring system may identify a contextual alert to provide in response to determining that the furnace is malfunctioning. For example, the monitoring system may determine to show a blue light in response to determining that the furnace of the property is malfunctioning.

The identified contextual alert associated with the particular detected event is output at a notification device (312). For example, the monitoring system can control a notification device to output the contextual alert that was identified as corresponding to the particular detected event. For instance, in response to determining that the furnace of the property is malfunctioning, the monitoring system may identify a contextual alert that corresponds to detecting a malfunctioning furnace, such as causing a light of a notification device at the property to glow blue, and can control the notification device to cause the light to glow blue.

Figure 4:
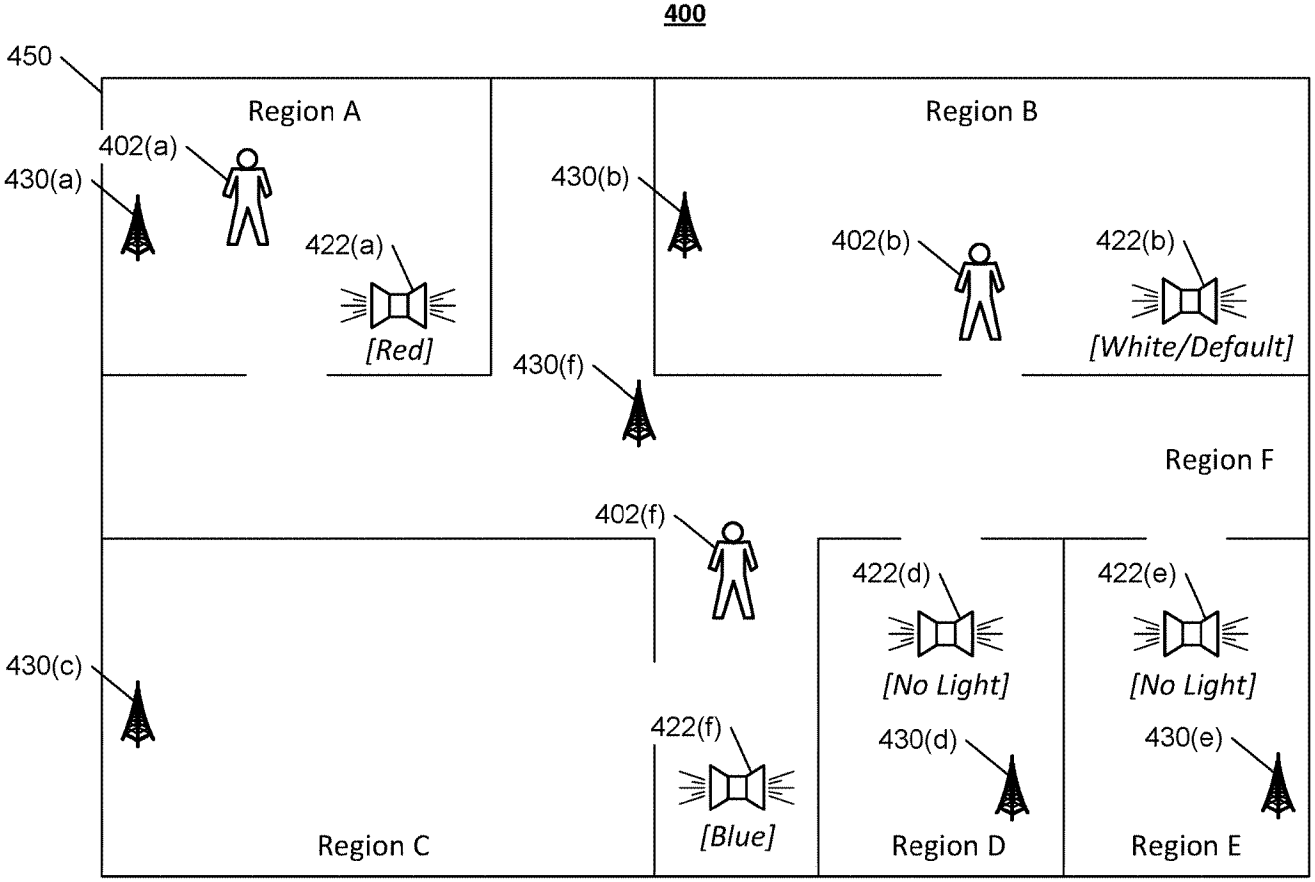
FIG. 4 illustrates an example of providing contextual alerts based on the location of users within a property.

FIG. 4 depicts an example in which a monitoring system 100 provides different contextual alerts corresponding to different detected events at various locations within a property 450. In some implementations, the monitoring system 400 includes multiple sensors 430(*a*)-430(*e*) that are capable of detecting the presence of users 402(*a*)-402(*c*) in different regions (A)-(F) of the property 450. As described, the monitoring system 400 can determine that multiple different events have occurred. For example, the monitoring system 400 may determine that a first and a second event have occurred, e.g., that it is likely to rain in the geographical area of the property 450 and that an air filter for a furnace of the property 450 needs to be replaced. The monitoring system 400 may also determine that there are users 402(*a*)-402(*c*) of the property in regions (A), (B), and (F) of the property 450.

Based on determining that the first and second events have occurred and that there are users 402(*a*)-402(*c*) in regions (A), (B), and (F) of the property, the monitoring system may determine to output different contextual alerts at different notification devices within the property 450. The monitoring system 400 may determine to output a first contextual alert corresponding to the first detected event at the notification device 422(*f*), may determine to output a second contextual alert corresponding to the second detected event at the notification device 422(*a*), and may determine to activate a notification device 422(*b*) to a state that is not associated with any particular contextual alert, or a default state, e.g., by causing the notification device 422(*b*) to glow white. For example, based on determining that an air filter for the furnace of the property 450 needs to be replaced, and optionally that the user 402(*a*) has been detected in region (A) of the property 450, the monitoring system 400 may control the notification device 422(*a*) to provide a particular contextual alert, e.g., by causing a tunable LED included in the notification device 422(*a*) to glow red. Similarly, based on determining that it is likely to rain in the geographical area of the property 450, and optionally that the user 402(*c*) is located in region (F) of the property 450, the monitoring system 400 may control the notification device 422(*f*) to provide a different contextual alert, e.g., by causing a tunable LED included in the notification device 422(*f*) to glow blue. The notification device 400 can also optionally control the notification device 422(*b*) to change to a particular setting that is not associated with a particular detected event, for example, by controlling a tunable LED included in the notification device 422(*b*) to glow a white color. In such a way, the notification device 422(*b*) can operate to provide light to the user 402(*b*) who is in region (B) of the property 450. Additionally, as shown in FIG. 4, the monitoring system 400 may determine not to activate the notification devices 422(*d*) and 422(*e*), for example, based on the sensors 430(*d*) and 430(*e*) not detecting the presence of users in regions (D) or (E) of the property 450.

In some implementations, the monitoring system 400 can determine to provide a particular contextual alert corresponding to a particular detected event at a certain notification device based on the contextual alert being relevant to a particular region (A)-(F) of the property 450 where the notification device is located. For example, based on the region (A) of the property 450 being a location where a furnace of the property 450 is located, the monitoring system 400 can determine to output the contextual alert indicating that the air filter for the furnace needs to be replaced at the notification device 422(*a*) located in the region (A) of the property 450.

Additionally, in some implementations, the monitoring system 400 can determine to provide a particular contextual notification based on detecting the proximity of a user within the property 450 to an object of the particular contextual alert or based on the proximity of a user relative to a particular notification device. For example, the monitoring system 400 can determine that the user 402(*a*) is located near a furnace of the property 450 or near the notification device 422(*a*), and can provide the contextual alert causing the tunable LED included in the notification device 422(*a*) to glow red based on determining that the user 402(*a*) is located near the notification device 422(*a*) or near the furnace of the property.

Figure 5:
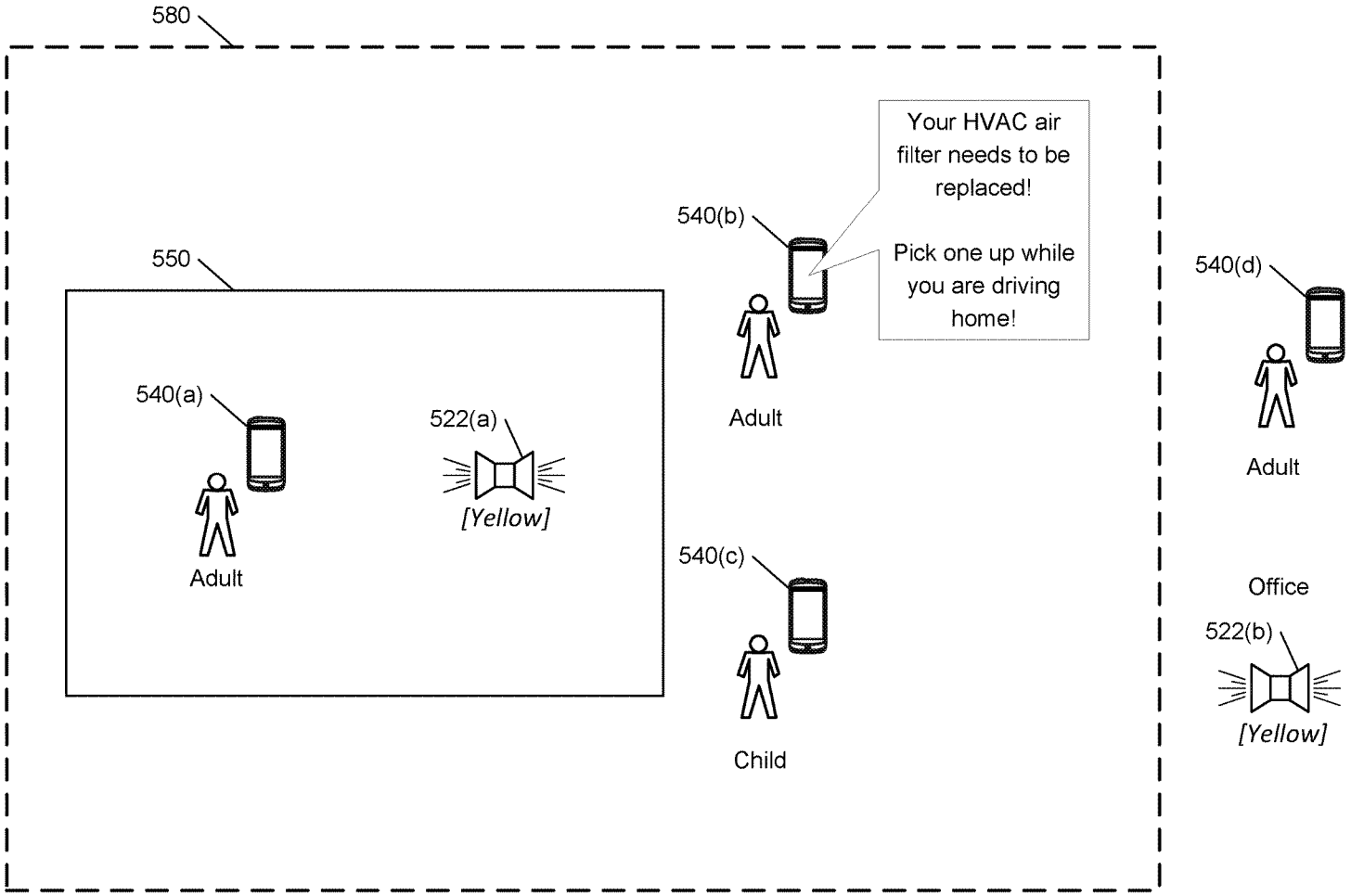
FIG. 5 illustrates an example of providing contextual alerts to users based the locations and identities of users.

FIG. 5 depicts an example implementation in which the notification system 500 provides contextual alerts to one or more users of the property 550 based on characteristics of users, e.g., their identity, and user locations, e.g., relative to the property 550. For example, as shown in FIG. 5, the monitoring system 500 may determine to provide a particular contextual alert to one or more mobile devices 540(*a*)-540(*d*) associated with users of the property 550 based on the identity of the users associated with each mobile device 540(*a*)-540(*d*) and based on the locations of the mobile devices 540(*a*)-540(*d*) associated with those users.

For example, as shown in FIG. 5, the monitoring system 500 may determine that a particular event has occurred. Based on determining that the event has occurred, the monitoring system 500 can determine to provide a contextual alert corresponding to the detected event. For example, the monitoring system 500 may determine to provide a contextual alert at a notification device 522(*a*) associated with the monitoring system 500 and located at the property 550, or at the notification device 522(*b*) associated with the monitoring system 500 and located at an office of a user of the property 550. Additionally, the monitoring system 500 may identify one or more mobile devices 540(*a*)-540(*d*) that are also to receive a contextual alert. For example, the monitoring system 500 can determine identities of users associated with each of the mobile devices 540(*a*)-540(*d*) and can provide contextual notifications to one or more of the mobile devices 540(*a*)-540(*d*) based on the identities of the users associated with those mobile devices. For example, based on determining that the mobile device 540(*b*) is associated with an adult user and that the mobile device 540(*c*) is associated with a child user, the monitoring system 500 may determine to transmit a contextual alert to the mobile device 540(*b*) and not to the mobile device 540(*c*). For example, based on determining that an air filter for a furnace of the property 550 needs to be replaced, the monitoring system 500 can send a contextual alert to the mobile device 540(*b*) that causes the mobile device 540(*b*) to output the alert reading "Your HVAC air filter needs to be replaced! Pick one up while you are driving home!"

Additionally or alternatively, the monitoring system 500 may determine to provide contextual alerts at one or more of the mobile devices 540(*a*)-540(*d*) based on a location of the mobile devices 540(*a*)-540(*d*). For example, the monitoring system 500 may identify mobile devices that are outside of the property 550 and that are within a perimeter or threshold distance 580 of the property 550. For example, based on determining that both the mobile devices 540(*b*) and 540(*d*) are associated with adult users and that the user 540(*b*) is located within the perimeter or threshold distance 580 of the property 550 while the user associated with the mobile device 540(*d*) is located outside of the perimeter or threshold distance 580 of the property 550, the monitoring system 500 can determine to transmit a contextual alert to the mobile device 540(*b*) and not to transmit a contextual alert to the mobile device 540(*d*). In some implementations, the monitoring system 500 may determine to transmit contextual alerts to all users or users within the perimeter or threshold distance 580 of the property 550 regardless of whether they are within the property 550, for example, such that the mobile device 540(*a*) may also receive a contextual alert. Similarly, the monitoring system 500 may determine to send the contextual alert to the mobile device 540(*c*) associated with the child user, for example, if the monitoring system 500 does not limit the contextual alerts to users of particular age groups.

Additionally, the monitoring system 500 may determine to provide a contextual alert relating to a detected event at one or more of the notification devices 522(*a*)-522(*b*). For example, based on determining that the air filter for the furnace of the property 550 needs to be replaced, the monitoring system 500 may determine to output a contextual alert to notify users of the property 550 that the air filter needs to be replaced at the notification device 522(*a*) located at the property 550, and/or at the notification device 522(*b*) located remotely from the property 550 at an office.

In some instances, determining whether to provide a contextual alert at a particular notification device 522(*a*)-522(*b*) may be dependent on the particular event detected by the monitoring system 500. For example, the monitoring system 500 may determine to provide a contextual alert at the notification device 522(*b*) that corresponds to the monitoring system 500 detecting a user of the property 550 arriving at the property 550, and may determine not to provide such a contextual alert at the notification device 522(*a*), since providing such a contextual alert at the notification device 522(*a*) may not be necessary. However, based on the monitoring system 500 determining that an intruder may have entered the property 550, the monitoring system 500 may cause contextual alerts to be provided at both of the notification devices 522(*a*)-522(*b*).

In some implementations, the monitoring system 500 may determine whether to provide a contextual alert at a particular notification device 522(*a*)-522(*b*) based on the locations of one or more users of the monitoring system 500. For example, the notification device 522(*b*) may be located at an office of a particular user associated with the mobile device 540(*d*). Based on the monitoring system 500 detecting an event and determining that the mobile device 540(*d*) associated with the particular user is located at the property 550, or within the threshold distance 580, the monitoring system 500 may determine not to provide a contextual alert at the notification device 522(*b*), since it is unlikely that the particular user is located at their office. If the mobile device 540(*d*) associated with the particular user is located away from the property 550, for example, outside of the distance threshold 580 from the property 550, or outside of the property 550 but within the threshold distance 580, the monitoring system 500 may determine to provide a contextual alert at the notification device 522(*b*) based on it being more likely that the particular user is located at their office. In some implementations, the monitoring system 500 can determine whether to provide a contextual alert corresponding to an event, condition, or user location detected by the monitoring system 500 based on a combination of both one or more user locations and the type of detected event, condition, or user location.

Figure 6:
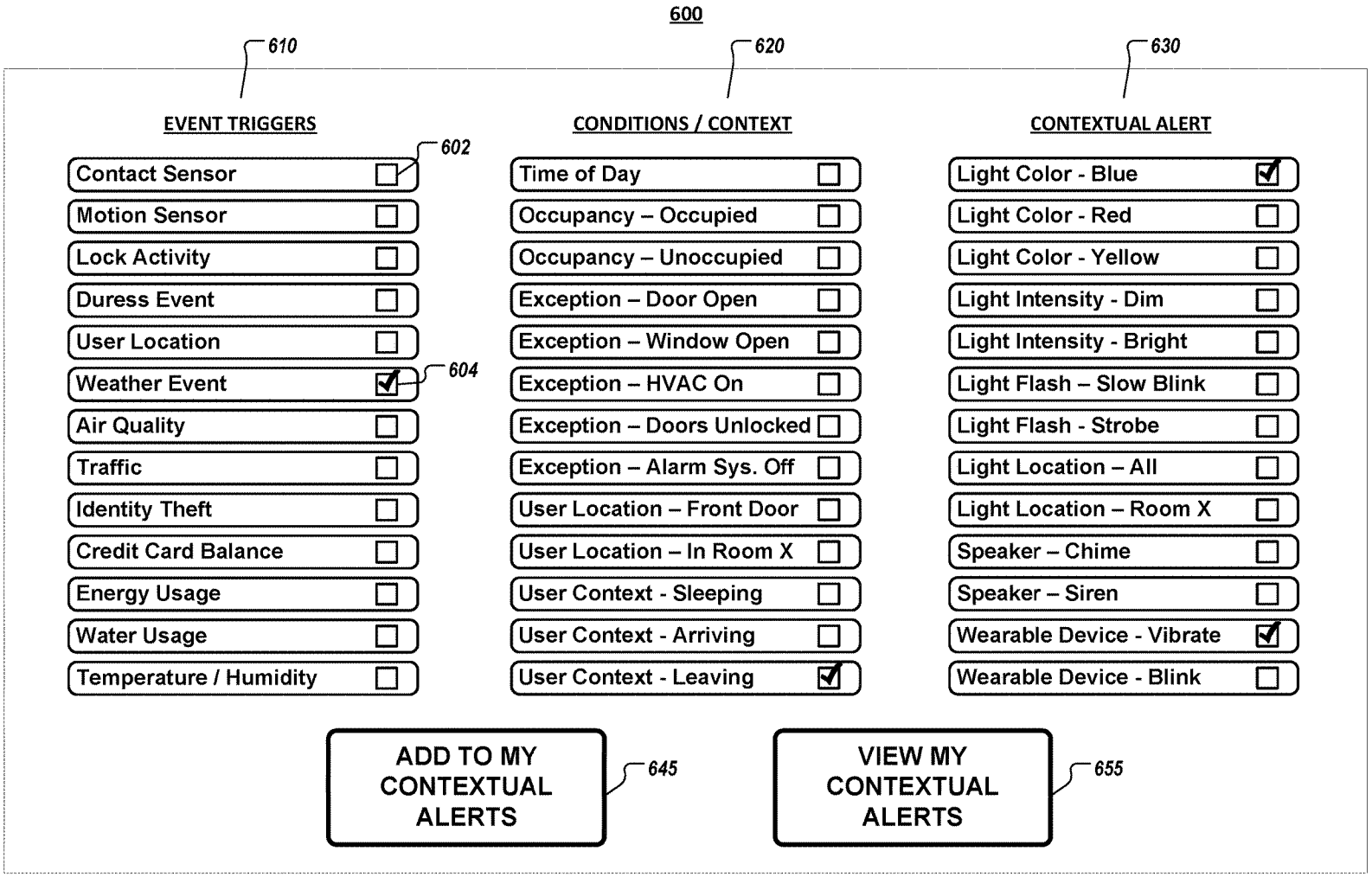
FIG. 6 illustrates an example menu for configuring contextual alerts.

FIG. 6 displays an example of a user interface 600 that may allow a user of a property to specify contextual alerts that a monitoring system can provide in response to detecting specific triggering events. For example, the interface 600 may be presented to a user at a website accessible at a mobile device 240, 250 running a native application 242, 252 may be presented to a user at a website that is accessible over the network 205 or another network, or may be presented to a user at an interface associated with the contextual communication server 260.

Briefly, the interface 600 includes one or more event trigger options 610, one or more conditions or context options 620, and one or more contextual alerts 630. Each of the event trigger options 610, conditions or context options 620, and contextual alerts 630 are featured with a selection button 602 that enables a user of a property to select the option. Upon selecting an option (e.g., by clicking on a selection button 602 associated with the option, highlighting the option, etc.), the selection button 602 may change to a checked selection button 604, indicating that the user has successfully selected the option. For example, as shown, the user associated with the property has selected the option associated with a "weather event," the option associated with a "user context—leaving," and the option associated with providing both a "light color—blue" and a "wearable device—vibrate" option. Based on the selection of the options, the user may select the button 645 to add the trigger event and associated options to a set of trigger events that the monitoring system associated with the property can detect. Thus, based on the monitoring system detecting a particular weather event (e.g., based on receiving a weather forecast that indicates that it is likely to rain) and detecting that the user is about to leave the property, the monitoring system can provide a contextual alert to the user to indicate that it is likely to rain by causing a light associated with the monitoring system to shine blue and by causing a wearable device (e.g., a mechanical bracelet that the user wears) to vibrate. In addition, the user may select the button 655 to view all trigger events that the monitoring system associated with the property can detect, and can edit or remove one or more of the trigger events.

In some implementations, a user may select more than one event trigger option 610, more than one condition or context option 620, and/or more than one contextual alert 630. Based on the user selecting more than one event trigger option 610, the monitoring system may only determine that the triggering event has been detected based on all of the event triggers being satisfied. For example, if the user had selected both the "lock activity" option and the "motion sensor" option, the monitoring system may only detect a triggering event based on determining that a motion sensor has detected motion while the external doors of the property are locked. Similarly, if the user selects one or more conditions or context options, the monitoring system may only determine that a triggering event has occurred based on detecting that a selected event trigger and one or more conditions or contexts have all been satisfied.

The described systems, methods, and techniques may be implemented in digital electronic circuitry, computer hardware, firmware, software, or in combinations of these elements. Apparatus implementing these techniques can include appropriate input and output devices, a computer processor, and a computer program product tangibly embodied in a machine-readable storage device for execution by a programmable processor. A process implementing these techniques can be performed by a programmable processor executing a program of instructions to perform desired functions by operating on input data and generating appropriate output. The techniques can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices;

magnetic disks such as internal hard disks and removable disks; magneto-optical disks; and Compact Disc Read-Only Memory (CD-ROM). Any of the foregoing can be supplemented by, or incorporated in, specially designed application-specific integrated circuits (ASICs).

It will be understood that various modifications can be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. An electronic system comprising:

at least one processor; and at least one computer-readable storage medium coupled to the at least one processor having stored thereon instructions which, when executed by the at least one processor, causes the at least one processor to perform operations comprising:

receiving monitoring system data collected by a monitoring system that is associated with a property, the monitoring system including a notification device configured to output contextual alerts and sensors that are fixed within the property and that are configured to sense attributes of the property, the monitoring system being associated with one or more client devices and one or more servers that are in communication with the monitoring system;

analyzing the monitoring system data against one or more event profiles that define events relating to the property or one or more users of the property;

determining, based on the analysis of the monitoring system data against the one or more event profiles that define events relating to the property or one or more users of the property, that a particular event has occurred;

determining, for each of the one or more client devices, (i) a location of the client device and (ii) an identity of a user assigned to the client device;

selecting, from among the one or more client devices, a particular client device to provide an alert that corresponds to the particular event, wherein the particular client device is selected based at least on:

determining that the identity of the user assigned to the particular client device is classified as being capable of addressing the particular event, and determining that the location of the particular client device is (i) outside of the property and (ii) within a threshold distance of the property;

accessing information that specifies contextual alerts to be provided by the notification device and alerts to be provided at the one or more client devices, wherein the contextual alerts to be provided by the notification device and the alerts to be provided at the one or more client devices correspond to events defined by the one or more event profiles;

identifying, based on the particular event and the information that specifies the contextual alerts to be provided by the notification device and the alerts to be provided at the one or more client devices, a particular contextual alert that corresponds to the particular event to be provided by the notification device, and a particular alert that corresponds to the particular event to be provided at the particular client device; and causing output of the particular contextual alert at the notification device and of the particular alert at the particular client device.

2. The electronic system of claim 1, wherein the notification device is a tunable light emitting diode (LED) device that is fixed within the property, and wherein the particular contextual alert is a color output of the tunable LED device or a pattern of light emission output by the tunable LED device.

3. The electronic system of claim 1, wherein the notification device is fixed at another property that is separate from the property.

4. The electronic system of claim 1, wherein the monitoring system data comprises at least one of (i) sensor data indicating one or more attributes of the property received from one or more of the sensors that are fixed within the property, (ii) location data indicating locations of the one or more client devices received from the one or more client devices, or (iii) data indicating one or more attributes of a geographical area corresponding to the property received from one or more of the servers.

5. The electronic system of claim 1, wherein determining, based on the analysis of the monitoring system data against the one or more event profiles that define events relating to the property or one or more users of the property, that a particular event has occurred comprises:

determining, based on the analysis of the monitoring system data against the one or more event profiles that define events relating to the property or one or more users of the property, that two or more events have occurred, the two or more events including the particular event;

identifying priority measures assigned to the two or more events; and selecting the particular event based at least on the priority measures assigned to the two or more events identifying the particular event as a highest priority event of the two or more events.

6. The electronic system of claim 1, wherein the monitoring system includes multiple notification devices that are each associated with a location within the property, and wherein causing output of the particular contextual alert at the notification device comprises:

determining a particular location within the property corresponding to the particular event;

selecting the notification device from among the multiple notification devices, based at least on the notification device being associated with a location within the property that corresponds to the particular location within the property corresponding to the particular event; and causing output of the particular contextual alert at the notification device based at least on selecting the notification device from among the multiple notification devices.

7. The electronic system of claim 1, wherein the operations comprise:

generating one or more activity profiles that each correspond to the property or to a user of the property based at least on an analysis of the monitoring system data, wherein the one or more activity profiles each indicate one or more events that have occurred at the property or one or more actions performed by a user of the property.

8. The electronic system of claim 1, wherein analyzing the monitoring system data against the one or more event profiles that define events relating to the property or one or more users of the property comprises analyzing the monitoring system data against one or more activity profiles that each correspond to the property or to a user of the property, the one or more activity profiles each indicating one or more events that have occurred at the property or one or more actions performed by a user of the property.

9. The electronic system of claim 1, wherein the notification device is associated with a default output state, and wherein causing output of the particular contextual alert at the notification device comprises:

controlling the notification device to output the particular contextual alert at the notification device;

receiving data indicating a user acknowledgement of the particular contextual alert output at the notification device; and in response to receiving the data indicating the user acknowledgement of the particular contextual alert output at the notification device, causing output of the default output state at the notification device by changing a state of the notification device.

10. The electronic system of claim 1, wherein the operations comprise:

receiving other monitoring system data collected by one or more other monitoring systems that are each associated with another property, each of the one or more other monitoring systems including sensors that are fixed within another property and that are configured to sense attributes of the other property, and each of the one or more other monitoring systems being associated with one or more client devices that are each distinct from the notification device;

analyzing the other monitoring system data against one or more event profiles that define events relating to the other property or one or more users of the other property; and determining, based on (i) the analysis of the monitoring system data against the one or more event profiles that define events relating to the property or one or more users of the property, and (ii) the analysis of the other monitoring system data against the one or more event profiles that define events relating to the other property or one or more users of the other property, that the particular event has occurred.

11. A method comprising:

receiving monitoring system data collected by a monitoring system that is associated with a property, the monitoring system including a notification device configured to output contextual alerts and sensors that are fixed within the property and that are configured to sense attributes of the property, the monitoring system being associated with one or more client devices and one or more servers that are in communication with the monitoring system;

analyzing the monitoring system data against one or more event profiles that define events relating to the property or one or more users of the property;

determining, based on the analysis of the monitoring system data against the one or more event profiles that define events relating to the property or one or more users of the property, that a particular event has occurred;

determining, for each of the one or more client devices, (i) a location of the client device and (ii) an identity of a user assigned to the client device;

selecting, from among the one or more client devices, a particular client device to provide an alert that corresponds to the particular event, wherein the particular client device is selected based at least on:

determining that the identity of the user assigned to the particular client device is classified as being capable of addressing the particular event, and determining that the location of the particular client device is (i) outside of the property and (ii) within a threshold distance of the property;

accessing information that specifies contextual alerts to be provided by the notification device and alerts to be provided at the one or more client devices, wherein the contextual alerts to be provided by the notification device and the alerts to be provided at the one or more client devices correspond to events defined by the one or more event profiles;

identifying, based on the particular event and the information that specifies the contextual alerts to be provided by the notification device and the alerts to be provided at the one or more client devices, a particular contextual alert that corresponds to the particular event to be provided by the notification device, and a particular alert that corresponds to the particular event to be provided at the particular client device; and causing output of the particular contextual alert at the notification device and of the particular alert at the particular client device.

12. The method of claim 11, wherein the notification device is a tunable light emitting diode (LED) device that is fixed within the property, and wherein the particular contextual alert is a color output of the tunable LED device or a pattern of light emission output by the tunable LED device.

13. The method of claim 11, wherein the monitoring system data comprises at least one of (i) sensor data indicating one or more attributes of the property received from one or more of the sensors that are fixed within the property, (ii) location data indicating locations of the one or more client devices received from the one or more client devices, or (iii) data indicating one or more attributes of a geographical area corresponding to the property received from one or more of the servers.

14. The method of claim 11, wherein the monitoring system includes multiple notification devices that are each associated with a location within the property, and wherein causing output of the particular contextual alert at the notification device comprises:

determining a particular location within the property corresponding to the particular event;

selecting the notification device from among the multiple notification devices, based at least on the notification device being associated with a location within the property that corresponds to the particular location within the property corresponding to the particular event; and causing output of the particular contextual alert at the notification device based at least on selecting the notification device from among the multiple notification devices.

15. The method of claim 11, comprising:

generating one or more activity profiles that each correspond to the property or to a user of the property based at least on an analysis of the monitoring system data, wherein the one or more activity profiles each indicate one or more events that have occurred at the property or one or more actions performed by a user of the property.

16. The method of claim 11, wherein analyzing the monitoring system data against the one or more event profiles that define events relating to the property or one or more users of the property comprises analyzing the monitoring system data against one or more activity profiles that each correspond to the property or to a user of the property, the one or more activity profiles each indicating one or more events that have occurred at the property or one or more actions performed by a user of the property.

17. The method of claim 11, wherein the notification device is associated with a default output state, and wherein causing output of the particular contextual alert at the notification device comprises:

controlling the notification device to output the particular contextual alert at the notification device;

receiving data indicating a user acknowledgement of the particular contextual alert output at the notification device; and in response to receiving the data indicating the user acknowledgement of the particular contextual alert output at the notification device, causing output of the default output state at the notification device by changing a state of the notification device.

* * * * *